US007561829B2

(12) United States Patent
Akiyama

(10) Patent No.: US 7,561,829 B2
(45) Date of Patent: Jul. 14, 2009

(54) MOTOR CONTROL DEVICE, IMAGE FORMING APPARATUS, AND MOTOR CONTROL METHOD

(75) Inventor: Shigeki Akiyama, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 104 days.

(21) Appl. No.: 11/567,273

(22) Filed: Dec. 6, 2006

(65) Prior Publication Data

US 2007/0127948 A1 Jun. 7, 2007

(30) Foreign Application Priority Data

Dec. 6, 2005 (JP) ..... 2005-352015

(51) Int. Cl.
*G03G 15/00* (2006.01)

(52) U.S. Cl. ..... 399/167; 399/299; 399/301; 318/49; 318/59; 318/66; 318/77; 318/85

(58) Field of Classification Search ..... 399/167, 399/75, 88, 299, 301, 396, 310, 323; 318/560, 318/561, 609, 610, 41, 49, 55, 59, 66, 68, 318/77, 85

See application file for complete search history.

(56) References Cited

U.S. PATENT DOCUMENTS 4,580,084 A * 4/1986 Takahashi et al. ..... 388/844
4,752,804 A * 6/1988 Ohno ..... 399/300
5,881,346 A * 3/1999 Mori et al. ..... 399/301
6,198,495 B1 * 3/2001 Sawada ..... 347/233
6,278,857 B1 * 8/2001 Monji et al. ..... 399/301
6,408,157 B1 * 6/2002 Tanaka et al. ..... 399/301
6,671,470 B2 * 12/2003 Suzuki et al. ..... 399/69
6,823,133 B1 * 11/2004 Adkins et al. ..... 388/814
7,016,635 B2 * 3/2006 Koide ..... 399/299

FOREIGN PATENT DOCUMENTS

JP 2001-215771 8/2001
JP 2002-072606 3/2002
JP 2004-350385 12/2004

* cited by examiner

*Primary Examiner*—David M Gray
*Assistant Examiner*—G. M. Hyder
(74) *Attorney, Agent, or Firm*—Banner & Witcoff, Ltd

(57) ABSTRACT

A motor control device includes a velocity detection unit, a motor control unit, a phase difference detection unit, and a correction value calculation unit. The velocity detection unit detects each velocity of a plurality of driven bodies or of a plurality of motors which independently drives a corresponding one of the driven bodies. The motor control unit independently controls each of the motors based on the velocity and a predetermined velocity directive value. The phase difference detection unit detects a phase difference among each of the driven bodies. The correction value calculation unit calculates a correction value for the velocity or the velocity directive value based on the phase difference.

17 Claims, 20 Drawing Sheets

MOTOR CONTROL DEVICE, IMAGE FORMING APPARATUS, AND MOTOR CONTROL METHOD

CROSS-REFERENCE TO RELATED APPLICATIONS

This application claims the benefit of Japanese Patent Application No. 2005-352015 filed Dec. 6, 2005 in the Japan Patent Office, the disclosure of which is incorporated herein by reference.

BACKGROUND

This invention relates to a motor control device that controls each of a plurality of motors which independently drives a corresponding one of a plurality of driven bodies. Particularly, the present invention concerns a motor control device and a motor control method of controlling a velocity of and a phase difference among each of the plurality of driven bodies to desired values, and an image forming apparatus including the motor control device.

In a conventional image forming apparatus that drives and rotates a plurality of photoreceptors to form a color image, it is necessary to control not only a rotational velocity of each of the photoreceptors to a predetermined value but also a rotational phase thereof to be consistent with each other. This is because eccentric rotation of each of the photoreceptors may cause a different surface velocity, even though the rotational velocity of each of the photoreceptors is the same. Therefore, it has been proposed to temporarily change each target velocity value of some of the photoreceptors according to phase difference among each of the photoreceptors so as to correct the phase difference.

SUMMARY

However, in the conventional image forming apparatus, correction of the phase difference is performed after the rotational velocity of each of the photoreceptors is controlled to a desired velocity. Thus, it takes time to control the rotational velocity of and the phase difference among each of the photoreceptors to the desired values. It has also been proposed in the conventional image forming apparatus to store, in a ROM, a data table composed of control variables for correction of phase differences. However, a huge data table is necessary in order to correct a phase difference while controlling a rotational velocity of each of the photoreceptors to a desired velocity. Accordingly, it is difficult in the conventional image forming apparatus to quickly control the rotational velocity and the phase difference to the desired values. The same problem occurs in various driving systems other than a driving system for an image forming apparatus, as well as in a driving system including reciprocation movement of a piston other than a driving system including rotational movement.

The present invention was made to solve the above problems. It would be desirable to provide a motor control device and a motor control method in which each velocity of the driven bodies or the motors is controlled to a desired velocity while a phase difference among each of the driven bodies is corrected, so that the velocity and the phase difference may be promptly controlled to desired values. It would be further desirable to provide an image forming apparatus including such a motor control device.

It is desirable that a motor control device of the present invention includes a velocity detection unit, a motor control unit, a phase difference detection unit, and a correction value calculation unit. The velocity detection unit detects each velocity of a plurality of driven bodies or of a plurality of motors which independently drives a corresponding one of the plurality of driven bodies. The motor control unit independently controls each of the motors based on the velocity detected by the velocity detection unit and a predetermined velocity directive value. The phase difference detection unit detects a phase difference among each of the driven bodies. The correction value calculation unit calculates a correction value for the detected velocity or the velocity directive value based on the phase difference detected by the phase difference detection unit.

According to the motor control device of the present invention as above, the correction value corresponding to the phase difference is reflected to the control of the motor control unit. Thereby, the phase difference can be corrected while the velocity of each of the driven bodies or motors is brought near to a velocity which corresponds to the velocity directive value. Therefore, the aforementioned velocity and the phase difference can be quickly controlled to the desired values.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

[Structure of Color Laser Printer]

Figure 1:
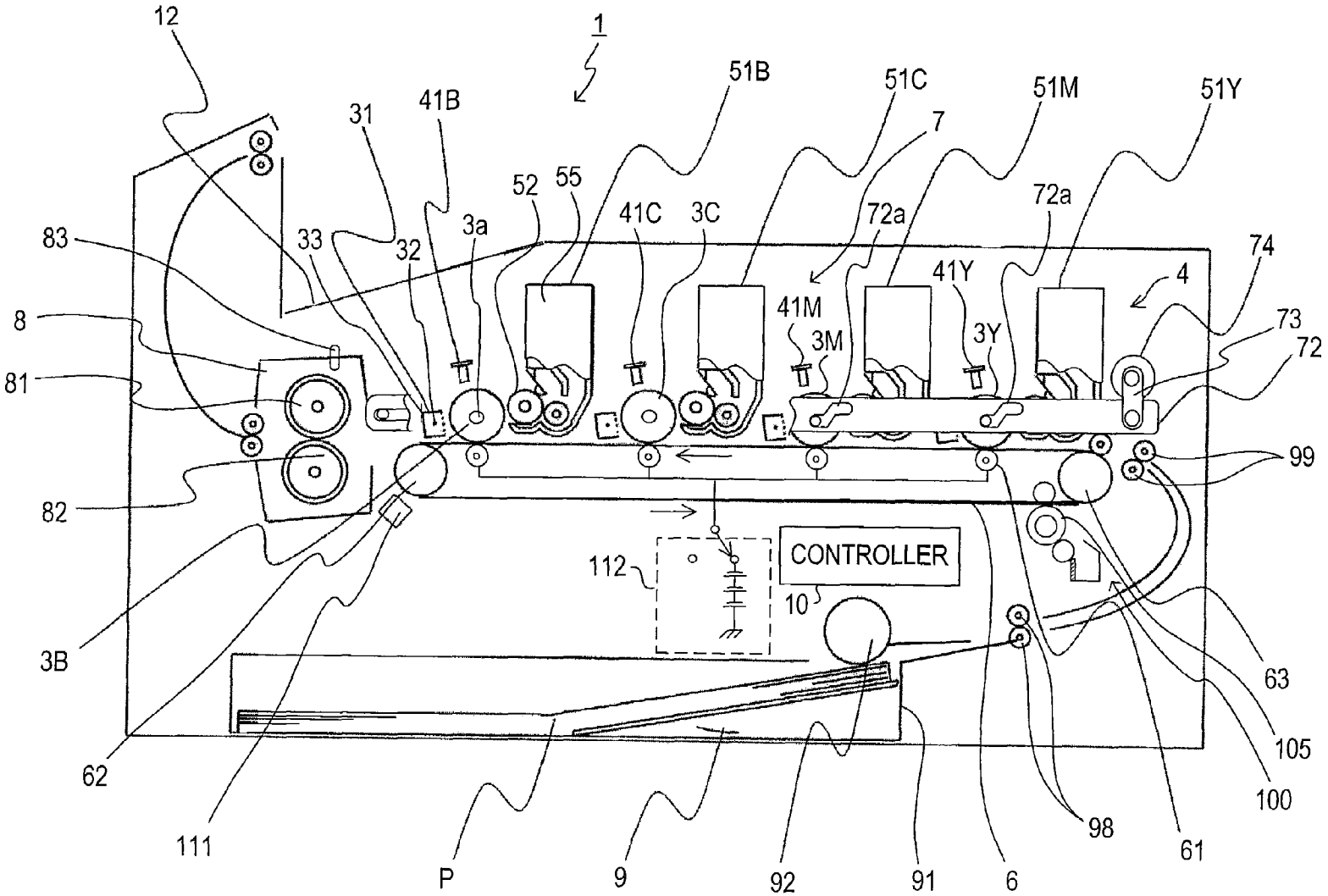
FIG. 1 is a schematic sectional view showing an internal structure of a color laser printer according to the present invention.

Referring to FIG. 1, a color laser printer (hereinafter, simply referred to as a printer) 1 has a recoding engine 7 provided with a toner image forming unit 4 and a paper conveying belt 6, a fixing unit 8, a paper feeding unit 9, a stacker 12, and a control unit 10. The printer 1 forms an image of four colors on recording paper P in accordance with externally inputted image data. Here, the image data may be text data or code data.

The toner image forming unit 4 is provided with four developing units 51Y, 51M, 51C and 51B. Each of the developing units 51Y, 51M, 51C and 51B contains a toner of different colors, i.e., yellow, magenta, cyan and black. Each of the development units 51Y, 51M, 51C, and 51B is provided with a photosensitive drum 3, a charger 31, and a scanner unit 41. The charger 31 uniformly charges the photosensitive drum 3. The scanner unit 41 exposes a surface of the charged photosensitive drum 3 with laser light to form an electrostatic image in accordance with the image data. Almost all of components of the scanner unit 41 are omitted in FIG. 1. Only a component part from which the laser light is emitted is shown in FIG. 1.

Hereinafter, structures of the components of the printer 1 will be described in detail In the following description, an alphabet of any one of Y for yellow, M for magenta, C for cyan, or B for black is added to a reference number when it is necessary to indicate the color. Otherwise, such alphabet is omitted.

Each of the four photosensitive drums 3 (3Y, 3M, 3C and 3B) in the toner image forming unit 4 is formed of a member having a substantially cylindrical shape. The photosensitive drums 3 are rotatably aligned at substantially constant intervals along a horizontal direction. The substantially cylindrical member of the photosensitive drum 3 is constituted of, for example, a substrate made from aluminum and a positively charged photosensitive layer formed on the substrate. The aluminum substrate is grounded on a ground line of the printer 1.

The charger 31 is a so-called scorotoron type charger. The charger 31 is provided with a charging wire 32 that extends in a width direction of the photosensitive drum 3 so as to face the photosensitive drum 3, and a shield case 33 that houses the charging wire 32 and has an opening on a side facing the photosensitive drum 3. The charger 31 charges the surface of the photosensitive drum 3 (e.g. to +700V) by applying a high voltage to the charging wire 32. The shield case 33 has a grid provided at the opening facing the photosensitive drum 3. The surface of the photosensitive drum 3 is charged to a potential substantially the same as a grid voltage by applying a predetermined voltage to the grid.

The scanner unit 41 (41Y, 41M, 41C, 41B) is provided on each of the photosensitive drums 3. The scanner unit 41 is disposed downstream of the charger 31 in a rotation direction of the photosensitive drum 3. The scanner unit 41 emits the laser light from a light source for one color of the externally inputted image data, and performs laser light scanning with a mirror surface of a polygon mirror, which is rotationally driven by a polygon motor, to irradiate the surface of the photosensitive drum 3 with the laser light.

When the scanner unit 41 irradiates the surface of the photosensitive drum 3 with the laser light according to the image data, a surface potential of the irradiated part is reduced (to +150 to +200 V) to form an electrostatic image on the surface of the photosensitive drum 3.

Each of the development units 51 (51Y, 51M, 51C and 51B) is provided with a development case 56 housing a corresponding color of toner, and a development roller 52. The development roller 52 is disposed downstream of the scanner unit 41 with respect to the rotation direction of the photosensitive drum 3 in such a manner as to contact the photosensitive drum 3. Each of the development units 51 positively charges the toner to supply the toner as a uniform thin layer to the photosensitive drum 3. The positively charged toner is carried to the positively charged electrostatic image formed on the photosensitive drum 3 at the contact part between the development roller 52 and the photosensitive drum 3 by a reverse development method. Thereby, the electrostatic image is caused to be developed.

The development roller 52 is made from a base material such as electroconductive silicone rubber. The development roller 52 has a cylindrical shape. A coating layer made from a resin containing fluorine or a rubber material is formed on a surface of the development roller 52. The toner housed in the development case 55 is a positively charged nonmagnetic one component toner. A yellow toner, a magenta toner, a cyan toner, and a black toner are respectively stored in the development units 51Y, 51M, 51C and 51B.

The paper feeding unit 9 is disposed at a lowermost part of the printer 1. The paper feeding unit 9 is provided with a housing tray 91 that stores recording paper P and a pickup roller 92 that feeds the recording paper P. The recording paper P stored in the housing tray 91 is fed from the paper feeding unit 9 sheet by sheet by the pickup roller 92 to be sent to the paper conveying belt 6 via conveying rollers 98 and registration rollers 99.

The paper conveying belt 6 has a width which is narrower than that of the photosensitive drum 3. The paper conveying belt 6 is in the form of an endless belt and runs together with the recording paper P with the recording paper P mounted thereon. The paper conveying belt 6 is held between a driving roller 62 which is driven by a not shown motor and a driven roller 63. Transfer rollers 61 are also provided on the opposite side of the respective photosensitive drums 3 via the paper conveying belt 6. As the driving roller 62 is driven and rotated by the motor, the paper conveying belt 6 moves in a counterclockwise direction as indicated by arrows in FIG. 1. The recording paper P sent from the registration rollers 99 is sequentially conveyed to between the photosensitive drums 3 and the paper conveying belt 6 so as to be sent to the fixing unit 8.

A toner removal unit 100 including a cleaning roller 105 is provided close to the driven roller 63, on the side of the paper conveying belt 6 not facing the photosensitive drums 3. Furthermore, a density detection sensor 111 is provided to face the paper conveying belt 6 on the driving roller 62. The density detection sensor 111 includes a light source that emits light in the infrared region, a lens that irradiates light from the light source on the paper conveying belt 6, and a photo transistor that receives reflection of the light. The density detection sensor 111 measures the density of a toner image on the paper conveying belt 6.

The transfer roller 61 transfers a toner image formed on the photosensitive drum 3 on the recording paper P conveyed by the paper conveying belt 6 when a transfer bias (e.g. −10 to −15 μA) which has a polarity reverse to that of the toner is applied between the transfer roller 61 and the photosensitive drum 3 by a current source 112 of a negative voltage.

The fixing unit 8 is provided with a thermal roller 81 and a pressure roller 82. The recording paper P on which the toner image has been transferred is heated and pressurized while being held and conveyed between the thermal roller 81 and the pressure roller 82. As a result, the toner image is fixed on the recording paper P. The fixing unit 8 also includes a sensor 83 that measures a temperature in the vicinity of the heating roller 81.

The stacker 12 is formed on a top surface of the printer 1. The stacker 12 is disposed at a discharge side of the fixing unit 8 to retain the recording paper P discharged from the fixing unit 8. The control unit 10 is provided with a controller with a known CPU and controls an overall operation of the printer 1.

The photosensitive drums 3 are held in such a manner as to be moved upward so that the photosensitive drums 3 can be detached from the paper conveying belt 6. The photosensitive drums 3 are positioned by a moving member 72 provided to extend over the photosensitive drums 3. The moving member 72 is formed of a plate-like member having a length sufficient to cover across all of the photosensitive drums 3. The moving member 72 is held so as to be moved in a horizontal direction in FIG. 1. The moving member 72 is provided with four guide holes 72*a* (only two of them are shown in FIG. 1; the other two are omitted) extending in the horizontal direction and having a substantially crank shape. Shafts 3*a* provided on a longitudinal side of the photosensitive drums 3 are fitted into the guide holes 72*a*.

The moving member 72 is connected to a lifting motor 74 via a link 73 for converting a rotational force into a horizontal force. The moving member 72 is moved to right or left as the lifting motor 74 rotates in response to an instruction signal from the control unit 10. When the moving member 72 is moved to the left, the guide holes 72*a*are also moved to the left and the shafts 3*a* of the respective photosensitive drums 3 move upward along the substantially crank shape of the guide holes 72*a*. As a result, the photosensitive drums 3 are detached from the paper conveying belt 6. In contrast, when the moving member 72 is moved to the right, the photosensitive drums 3 are brought into contact with the paper conveying belt 6. Normally, image forming is performed in a state that the photosensitive drums 3 are in contact with the paper conveying belt 6.

An operation of forming an image on recording paper P in the above printer 1 of the present embodiment is as follows. Firstly, a sheet of the recording paper P is supplied from the paper feeding unit 9 by the pickup roller 92 to be sent to the paper conveying belt 6 via the conveying rollers 98 and the registration rollers 99. Next, the surface of the photosensitive drum 3Y disposed at the rightmost position in FIG. 1 is uniformly charged by the charger 31 and then exposed to light by the scanner unit 41Y based on externally inputted image data for yellow, so that an electrostatic image is formed on the surface of the photosensitive drum 3Y. Then, a yellow toner which has been positively charged in the development unit 51Y is supplied to the surface of the photosensitive drum 3Y for development. The toner image formed in this manner is transferred onto the recording paper P, which is conveyed by the paper conveying belt 6, by the transfer roller 61 to which the transfer bias has been applied.

Subsequently, the recording paper P is conveyed to positions at which the recording paper P faces the respective photosensitive drums 3 for magenta, cyan, and black in turn. Toner images are formed on the surfaces of the photosensitive drums 3 in the same manner as for the yellow toner, and transferred onto the recording paper P by the transfer roller 61 in a superposing manner. Lastly, the toner images of the four colors formed on the recording paper P are fixed on the recording paper P in the fixing unit 8. The recording paper P is then discharged onto the stacker 12.

In the printer 1, when execution of calibration is instructed by the control unit 10, a known measuring patch is formed on the paper conveying belt 6. Density of the respective colors composing the measuring patch is measured by the density detection sensor 111 of the recording engine 7 at the time of forming the measuring patch. The measuring patch after the density measurements is removed by the cleaning roller 105 of the toner removal unit 100.

[Structure of Driving Unit of Photosensitive Drum]

Figure 2:
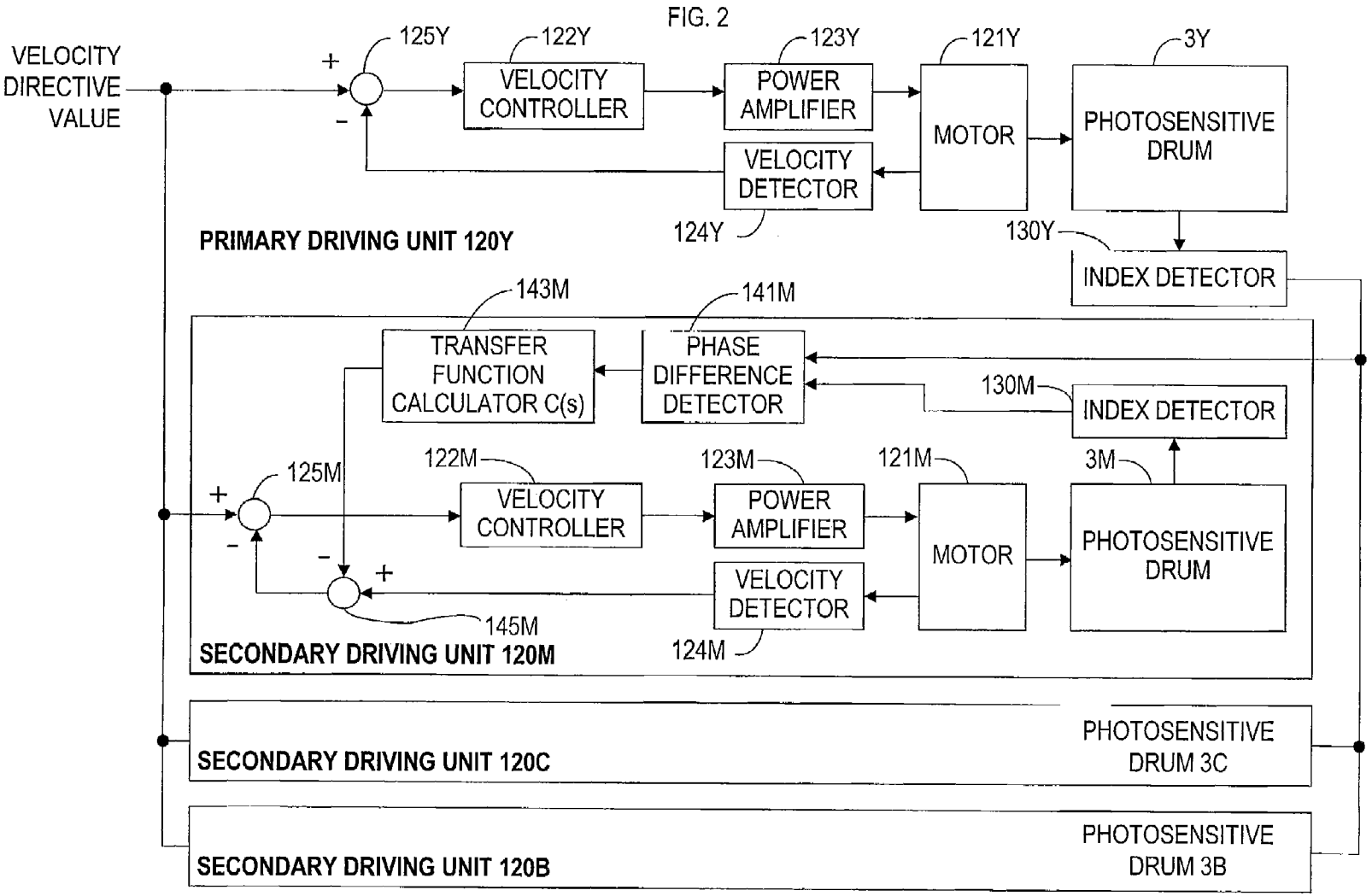
FIG. 2 is a block diagram showing structures of driving units for photosensitive drums of the printer.

FIG. 2 is a block diagram showing structures of driving units 120 (120Y, 120M, 120C and 120B) of the photosensitive drums 3.

In the present embodiment, the driving units 120M, 120C and 120B have the same structure. The driving unit 120Y has a different structure than the other driving units 120M, 120C and 120B. Hereinafter, the driving unit 120Y is referred to as the primary driving unit 120Y, and the other driving units 120M, 120C and 120B are referred to as the secondary driving units 120M, 120C and 120B. The details of the secondary driving units 120C and 120B are omitted in FIG. 2.

As shown in FIG. 2, each of the photosensitive drums 3Y, 3M, 3C and 3B is connected with each of the motors 121 (121Y, 121M, 121C and 121B; only the motors 121Y and 121M are shown in FIG. 2) via a not shown gear. Also, a driving power is inputted to each of the motors 121 via a velocity controller 122 (122Y, 122M, 122C, 122B; only the velocity controllers 122Y and 122M are shown in FIG. 2) and a power amplifier 123 (123Y, 123M, 128C, 123B; only the power amplifiers 123Y and 123M are shown in FIG. 2). A rotational velocity of each of the motors 121 is detected by a velocity detector 124 (124Y, 124M, 124C, 124B; only the velocity detectors 124Y and 124M are shown in FIG. 2).

In the primary driving unit 120Y of the photosensitive drum 3Y, the velocity detected by the velocity detector 124Y is subtracted from a velocity directive value as a directive value for control of each of the motors by a subtracter 125Y. The velocity controller 122Y performs feedback control of the velocity of the motor 121Y based on the value obtained by the above subtraction. In contrast, in the secondary driving units 120M, 120C and 120B of the photosensitive drums 3M, 3C and 3B, a feedback control which reflects a phase difference between the photosensitive drum 3Y and the photosensitive drum 3M, 3C or 3B is performed as follows.

That is, each of the photosensitive drums 3 is provided with an index detector 130 (130Y, 130M, 130C, 130D) that generates one index signal per one rotation of the photosensitive drum 3. Now, a structure of the index detector 130 is explained in detail by way of FIGS. 3A and 3B.

Figure 3A:
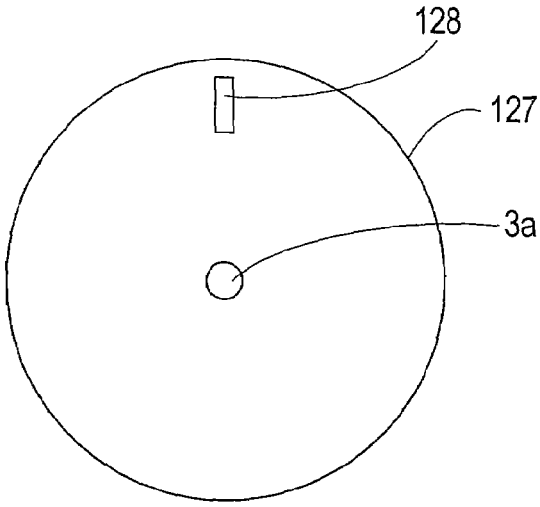
FIGS. 3A and 3B are front and side views, respectively, showing a structure of an index detector of the driving unit.
Figure 3B:
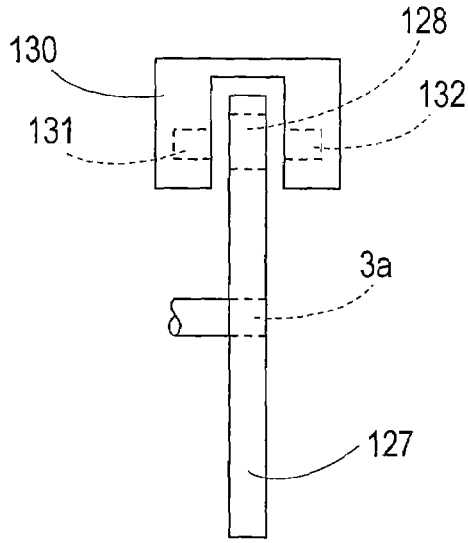

As shown in FIG. 3A, each of the photosensitive drum 3 is provided with a disk 127 which rotates on the shaft 3*a* together with the photosensitive drum 3. A slit 128 is bored at a position near the outer periphery of the disk 127. As shown in FIG. 3B, the index detector 130 is formed into a U-shape so that the outer peripheral side of the disk 127 can be interposed therethrough. The index detector 130 includes a light emitter 131 that irradiates light toward the disk 127 and a light receiver 132 that detects light passed through the slit 128 when the light emitter 131 faces the slit 28. When the photosensitive drum 3 is rotated to a predetermined phase where the slit 128 faces the light emitter 131, the light receiver 132 detects the light and generates an index signal.

Referring back to FIG. 2, for example, the secondary driving unit 120M of the photosensitive drum 3M is provided with a phase difference detector 141M that compares an index signal generated by the index detector 130M and an index signal generated by the index detector 130Y to detect a phase difference between the photosensitive drums 3Y and 3M. The phase difference detected by the phase difference detector 141M is inputted to the subtracter 145M after calculation by a transfer function calculator (transmission function C(s)) 143M. The subtracter 145M subtracts the output (hereinafter, referred to as a correction value) of the transfer function calculator 143M from the velocity detected by the velocity detector 124M, and then inputs the velocity after the subtraction to the subtracter 125M.

The subtracter 125M then subtracts the velocity obtained by the subtracter 145M from the velocity directive value. The velocity controller 122M performs a feedback control based on the value obtained from the subtracter 125M. Accordingly, the phase difference between the photosensitive drums 3Y and 3M can be corrected while the velocity of the photosensitive drum 3M is brought near to the velocity which corresponds to the velocity directive value.

Figure 4:
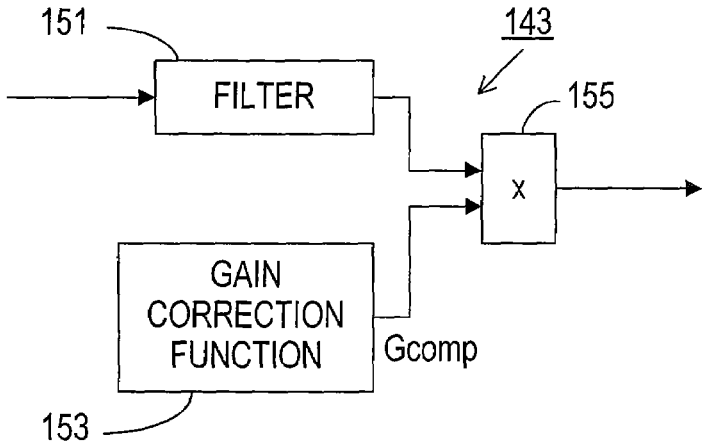
FIG. 4 is a block diagram showing details of a structure of a transfer function calculator of the driving unit.

FIG. 4 is a block diagram showing details of a structure of the transfer function calculator 143 (143M, 143C, 143B). As shown in FIG. 4, the transfer function calculator 143 is provided with a filter 151 (151M, 151C, 151B), a gain correction function unit 153 (153M, 153C, 153B), and a multiplier 155 (155M, 155C, 155B). The filter 151 removes high frequency component from the phase difference detected by the phase difference detector 141 (141M, 141C, 141B). The gain correction function unit 153 outputs a gain Gcomp. The multiplier 155 multiplies the phase difference which has passed the filter 151 by the gain Gcomp. Accordingly, by varying the gain Gcomp, a convergence state of the velocity and the phase difference of each of the photosensitive drums 3Y, 3M, 3C and 3B change as below.

In the following description, various transfer functions of the above control system are assumed as below. Firstly, various constants (electric and mechanical constants) to the motor 121, that is, wire inductance, wire resistance, input voltage, motor current, torque constant, back electromotive force constant, inertia of a motor shaft, viscosity resistance of a motor shaft, and rotation angular velocity are respectively defined as L, R, $V_c$, i, $K_t$, $K_e$, $J_1$, $D_1$, and $\omega_1$. Also, various constants to the photosensitive drums 3, that is, inertia of the shaft 3*a*, viscosity resistance of the shaft 3*a*, and rotation angular velocity are respectively defined as $J_2$, $D_2$, and $\omega_2$. A torsion torque constant by gear connection between the motors 121 and the photosensitive drum 3 is defined as $K_s$. Then, the following differential equations become true.

$$L\frac{di}{dt} + R \cdot i = V_c - K_e\omega_1$$

$$K_t \cdot i = J_1\frac{d\omega_1}{dt} + D_1\omega_1 + K_s\int(\omega_1 - \omega_2)dt$$

$$J_2\frac{d\omega_2}{dt} + D_2\omega_2 - K_s\int(\omega_1 - \omega_2)dt = 0$$

From the above, a transfer function of the motor 121 having an input of the input voltage $V_c$ and an output of the location of the photosensitive drum 3 can be expressed as below. In the following function, coefficients $a_0$ to $a_3$ and $b_0$ are determined by the aforementioned electrical and mechanical constants.

$$P = \frac{b_0}{s^4 + a_3 \cdot s^3 + a_2 \cdot s^2 + a_1 \cdot s + a_0}$$

A transfer function of phase advance-delay compensation as below can be applied to the velocity controller 122. In the following function, $T_1$ and $T_2$ are designing constants which determine a corner frequency, and $\alpha_1$ and $\alpha_2$ are designing constants which determine a low frequency (high frequency) increasing gain.

$$G(s) = K\left(\frac{T_1 \cdot s + 1}{\alpha_1 \cdot T_1 \cdot s + 1}\right)\left(\frac{\alpha_2(T_2 \cdot s + 1)}{\alpha_2 \cdot T_2 \cdot s + 1}\right)$$

where $\alpha_1 < 1, \alpha_2 > 1$

A well known transfer function of PID (Proportional-Integral-Derivative) control is obtained if put $\alpha_1=0$ and $\alpha_2=\infty$ in the above function. In the present embodiment, a transfer function G(s) is set as below.

$$G(s) = \frac{58s^2 + 807s + 700}{s^2 + 100s}$$

Furthermore, in the present embodiment, the following function having a low pass characteristic is applied to the filter 151 in view of stability. In the following function, $a_0$, $a_1$ and $b_0$ are designing constants. In the present embodiment, $a_0=b_0=1$ and $a_1=0.02$.

$$F_l(s) = \frac{b_0}{a_1 \cdot s + a_0}$$

Figure 5A:
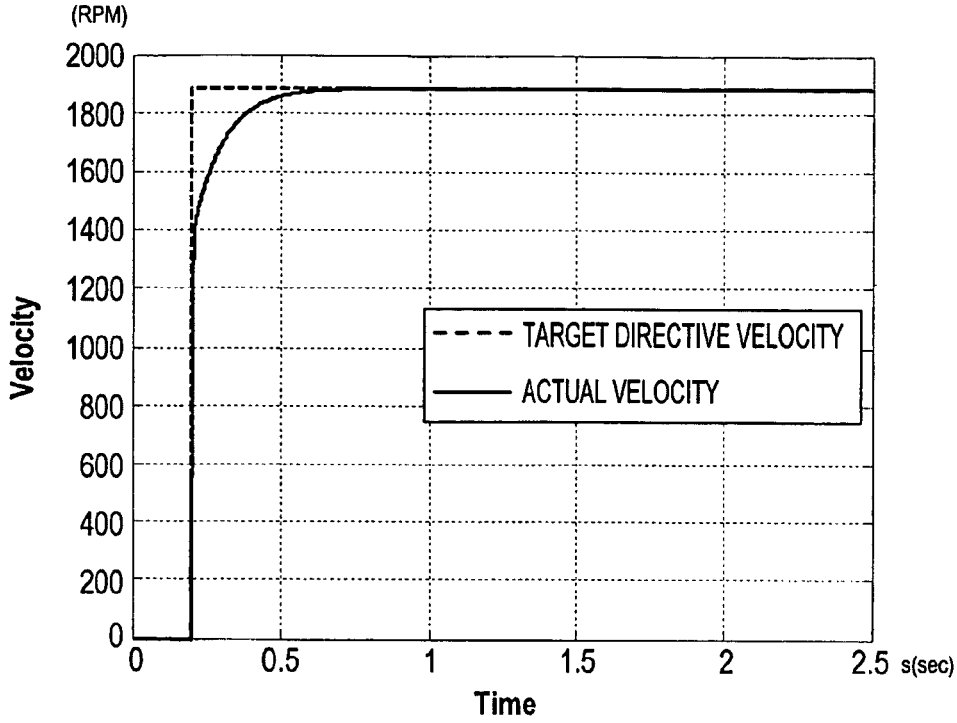
FIGS. 5A and 5B are graphs respectively showing a change in rotational velocity of the photosensitive drums in case that a secondary photosensitive drum is in phase advance.
Figure 5B:
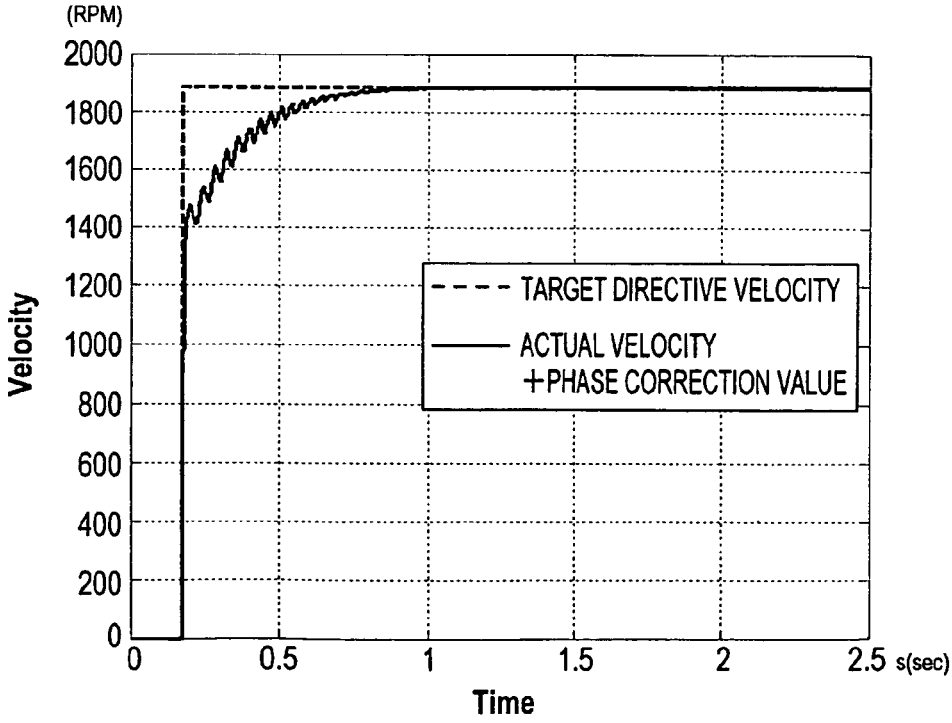

Under the conditions as above, the effect of the gain Gcomp in the transfer function calculator 143 is investigated. Firstly, the gain Gcomp is fixed to an intermediate value so as to learn the change in rotational velocity of the photosensitive drum 3Y and another photosensitive drum 3 (e.g., 3M; this can be 3C or 3B). FIGS. 5A and 5B are graphs respectively showing the change in rotational velocity of the photosensitive drum 3Y and the another photosensitive drum 3 (e.g., 3M) in case that the another photosensitive drum 3 (e.g., 3M) is in phase advance. The velocity of the photosensitive drum 3Y is feedback controlled regardless of a phase difference from the another photosensitive drum 3 (e.g., 3M). Accordingly, as shown in FIG. 5A, the velocity of the photosensitive drum 3Y smoothly converges to a target directive velocity. In contrast, the velocity of the another photosensitive drum 3 (e.g., 3M) is feedback controlled in reflection of the phase difference from the photosensitive drum 3Y. Accordingly, as shown in FIG. 5B, the velocity of the another photosensitive drum 3 (e.g., 3M) converges to the target directive velocity in an oscillating manner.

Figure 6A:
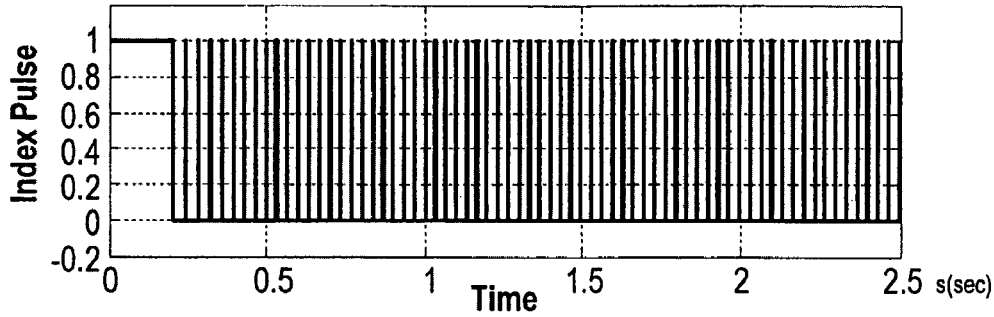
FIGS. 6A and 6B are explanatory views respectively showing an index signal generated during control in FIGS. 5A and 5B.
Figure 6B:
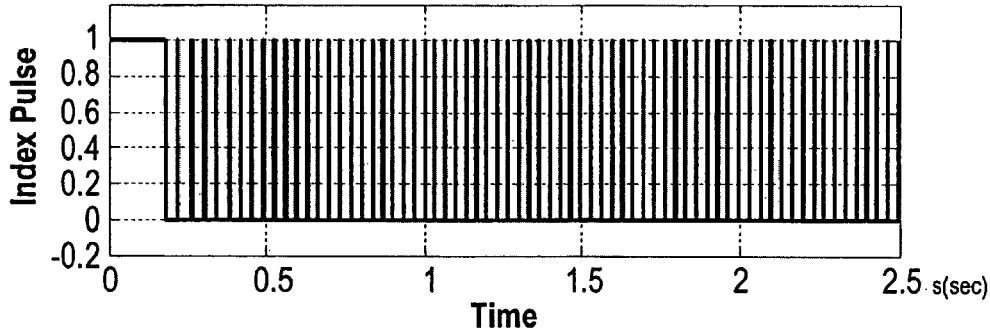
Figure 7:
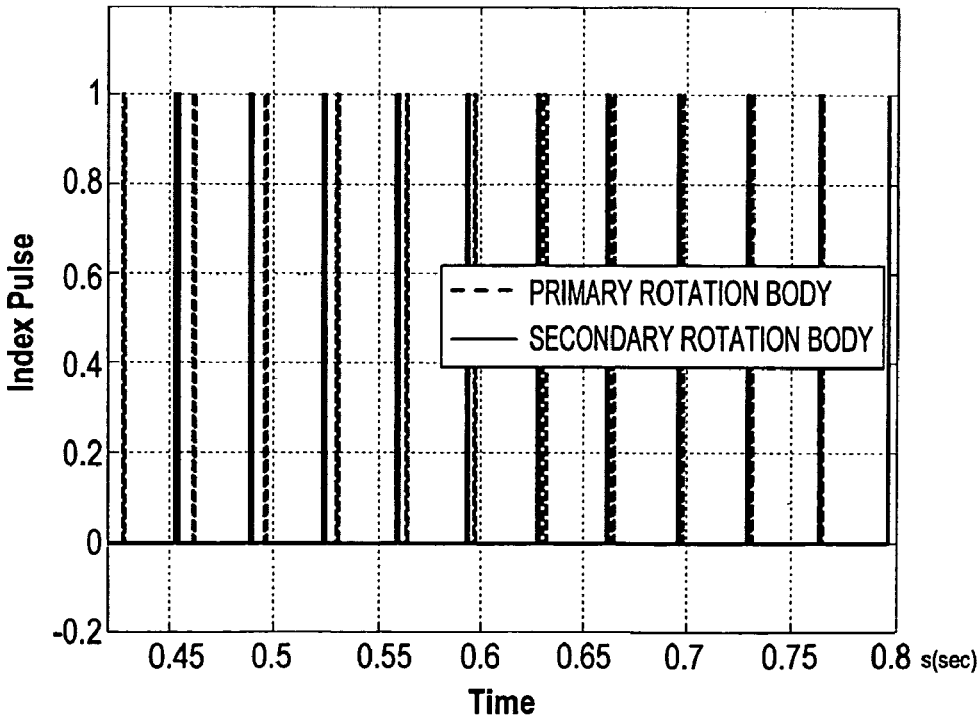
FIG. 7 is an enlarged view in which the respective index signals shown in FIGS. 6A and 6B are superposed on each other.

FIGS. 6A and 6B are explanatory views showing index signals respectively generated by the index detector 130Y and another index detector 130 (e.g., 130M; this can be 130C or 130B) during the above control. FIG. 7 is an enlarged view in which the respective index signals in FIGS. 6A and 6B are shown in a superposed manner. In FIG. 7, a "primary rotation body" shown in a dotted line represents the index signal from the index detector 130Y, and a "secondary rotation body" shown in a solid line represents the index signal from the another index detector 130 (e.g., 130M). As can be seen from FIGS. 5A, 5B and 7, the phase difference between the photosensitive drum 3Y and the another photosensitive drum 3 (e.g., 3M) is corrected while each of the photosensitive drum 3Y and the another photosensitive drum 3 (e.g., 3M) is accelerated to the target directive velocity.

Figure 8A:
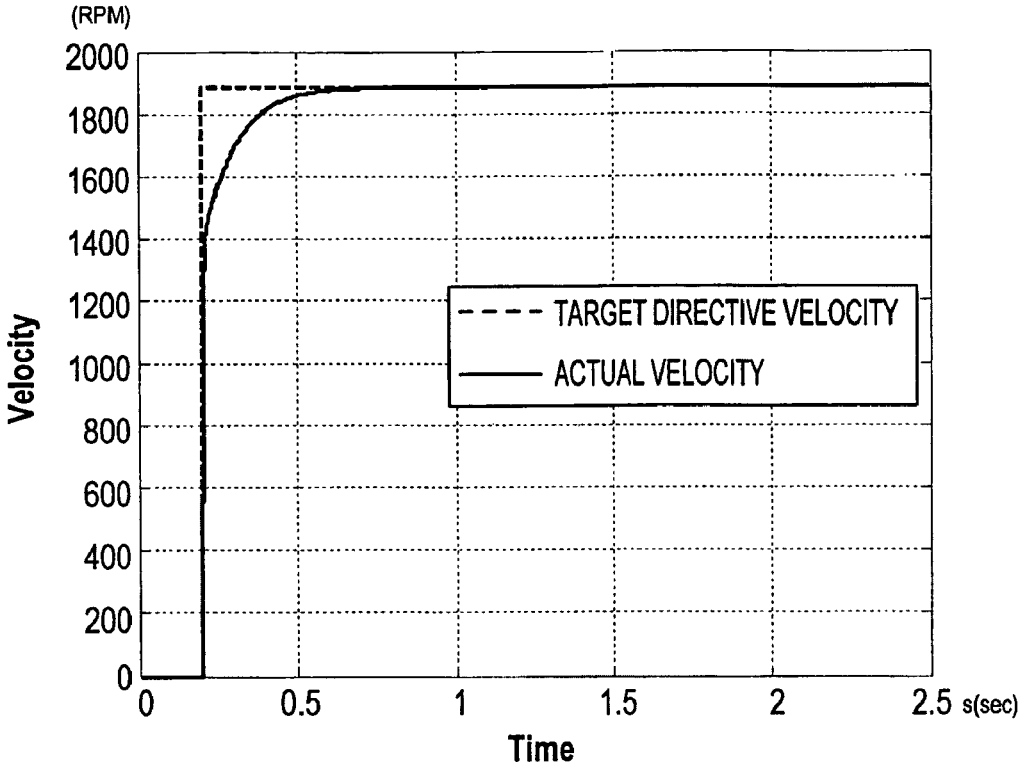
FIGS. 8A and 8B are graphs respectively showing a change in rotational velocity of the photosensitive drums in case that the secondary photosensitive drum is in phase delay.
Figure 8B:
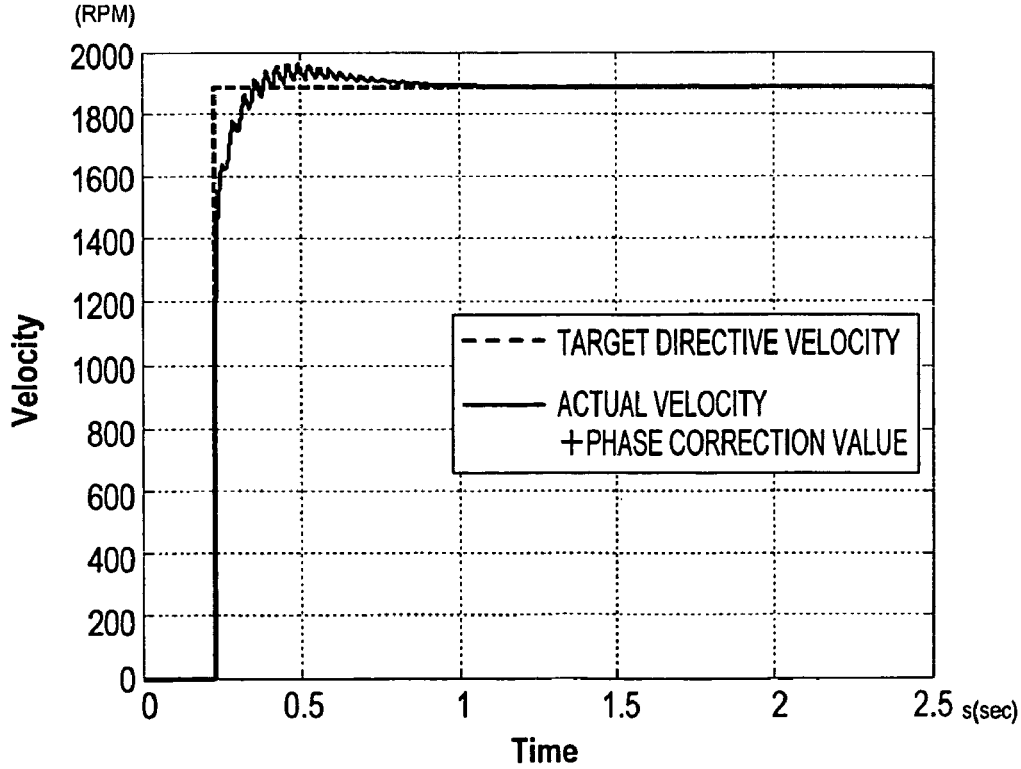
Figure 9A:
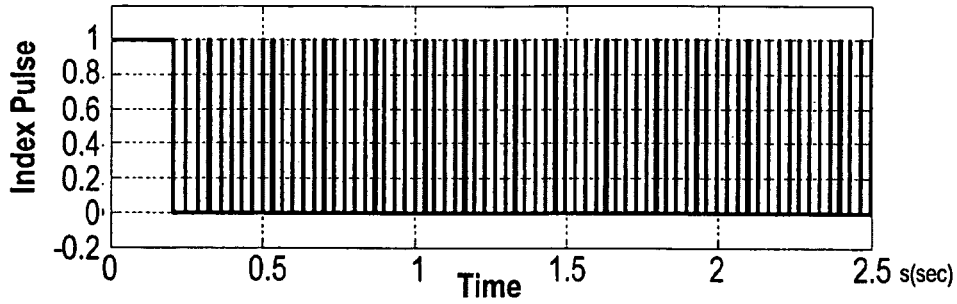
FIGS. 9A and 9B are explanatory views respectively showing an index signal generated during control in FIGS. 8A and 8B.
Figure 9B:
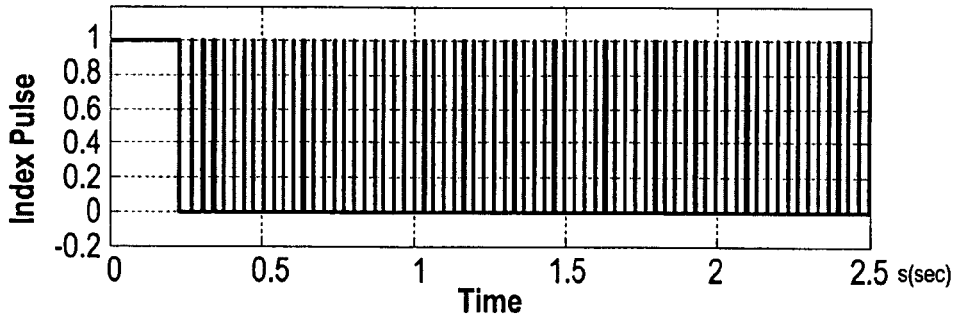
Figure 10:
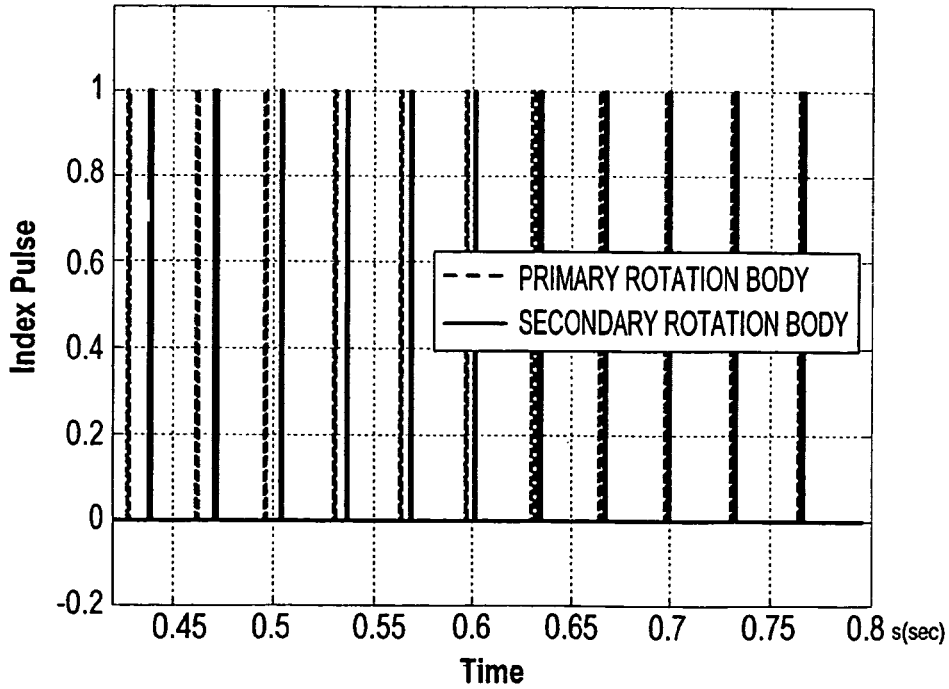
FIG. 10 is an enlarged view in which the respective index signals shown in FIGS. 9A and 9B are superposed on each other.

When the another photosensitive drum 3 (e.g., 3M) is in phase delay, the same result was obtained as well. FIGS. 8A and 8B are graphs respectively showing the change in rotational velocity of the photosensitive drum 3Y and the another photosensitive drum 3 (e.g., 3M) under the above control. FIGS. 9A and 9B are explanatory views respectively showing an index signal generated by the index detector 130Y and the another index detector 130 (e.g., 130M) under the same control. FIG. 10 is an enlarged view in which the index signals in FIGS. 9A and 9B are shown in a superposed manner. Also in FIG. 10, the "primary rotation body" and the "secondary rotation body" respectively represent the index signals of the index detector 130Y and the another index detector 130 (e.g., 130M). As can be seen in FIGS. 8A, 8B and 10, even in the case that the another photosensitive drum 3 (e.g., 3M) is in phase delay, the phase difference between the photosensitive drum 3Y and the another photosensitive drum 3 (e.g., 3M) is corrected while each of the photosensitive drum 3Y and the another photosensitive drum 3 (e.g., 3M) is accelerated to the target directive velocity.

Figure 11A:
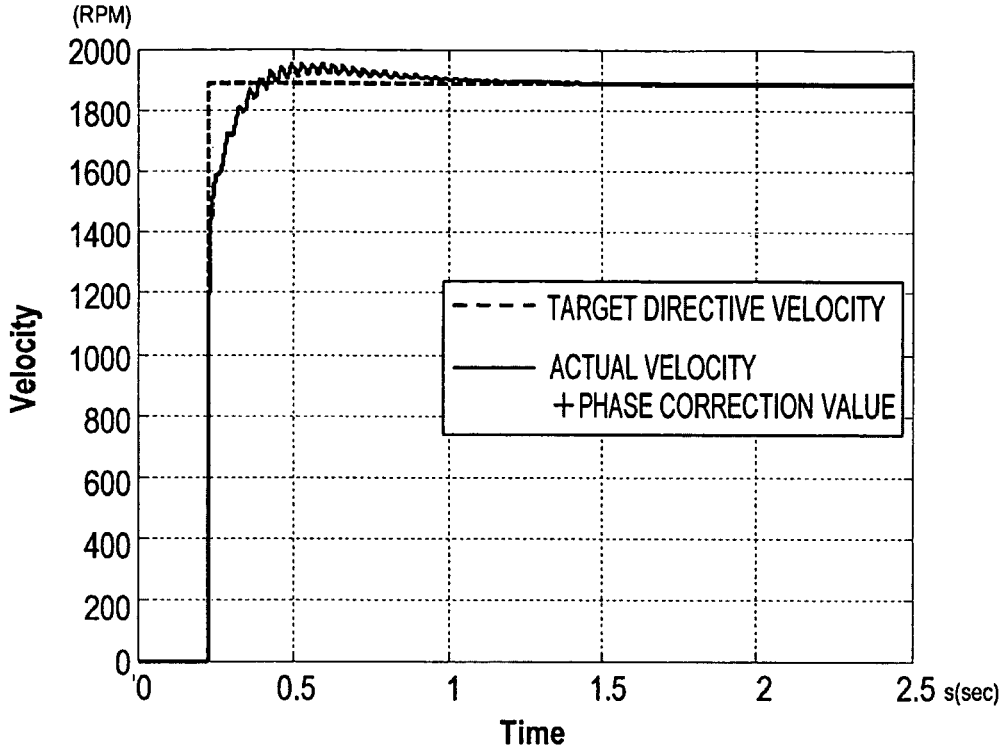
FIGS. 11A and 11B are graphs showing a change in rotational velocity of the secondary photosensitive drum in case that a gain is set to a relatively low value.
Figure 11B:
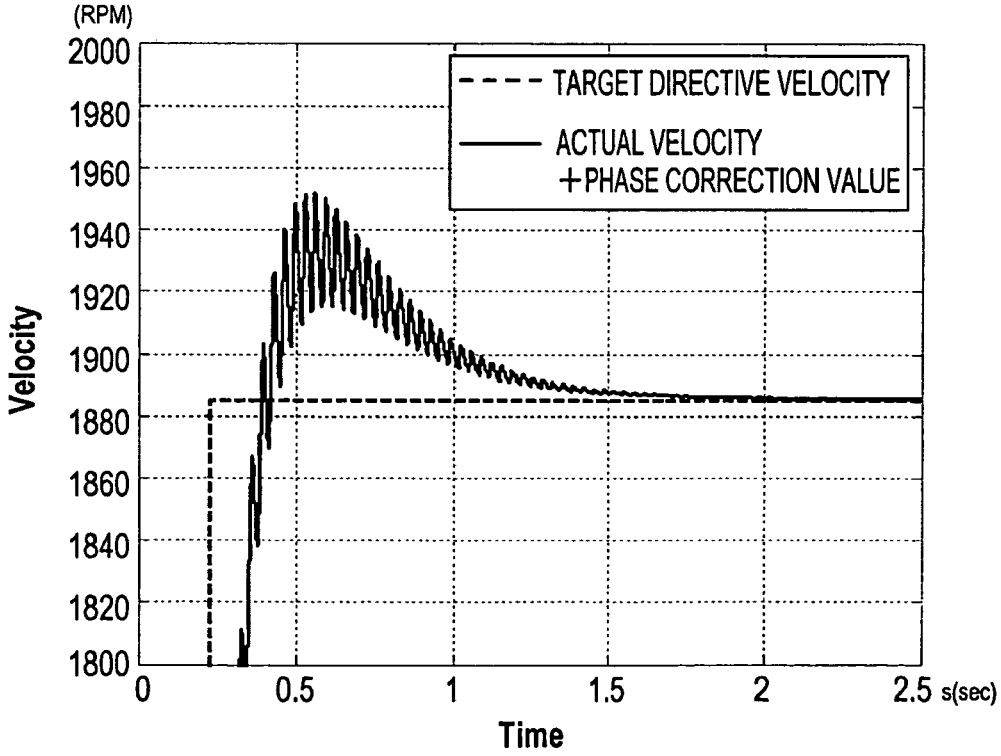

FIG. 11A is a graph showing the change in rotational velocity of the another photosensitive drum 3 (e.g., 3M) in case that the gain Gcomp is set to a relatively low value. FIG. 11B is a partially enlarged view of FIG. 11A. As seen from FIGS. 11A and 11B, when the gain Gcomp is set to be low, convergence of the phase difference is late but oscillation (amplitude) of the rotational velocity is small as compared to the case in which the gain Gcomp is set to a relatively high value. Also, after the phase difference is converged, no large oscillation occurs even by fluctuation due to disturbance. It was found that stability of the rotational phase (velocity) of the another photosensitive drum 3 (e.g., 3M) is favorable.

Figure 12A:
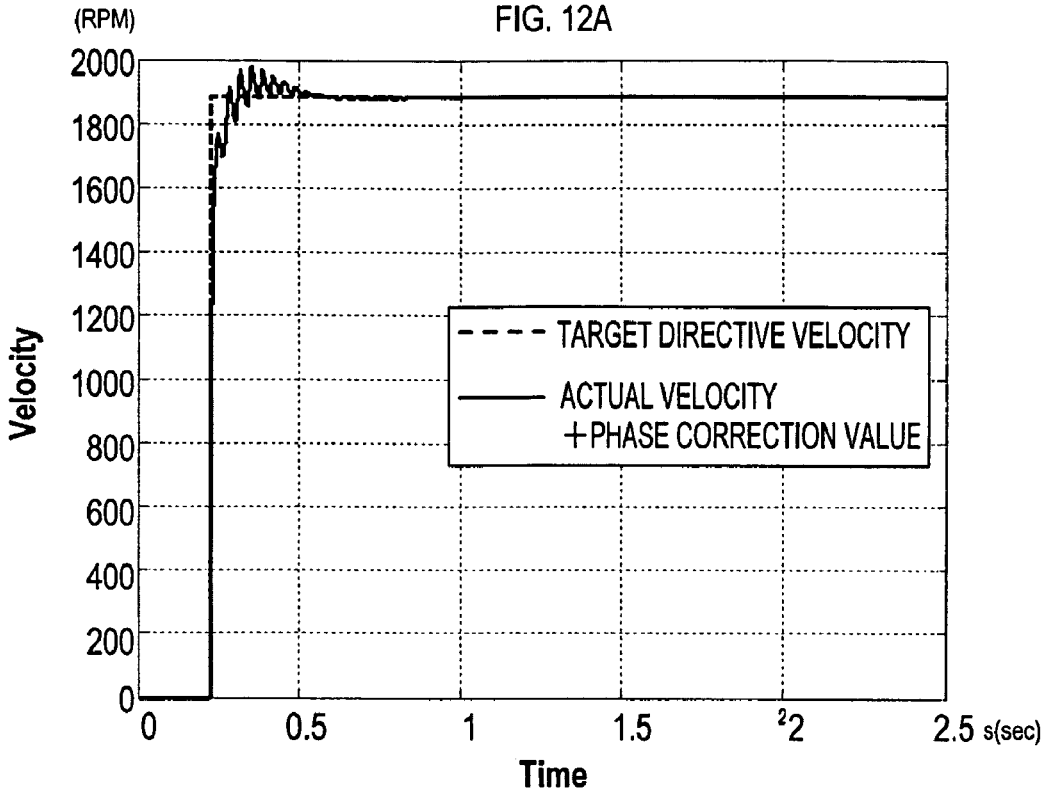
FIGS. 12A and 12B are graphs showing a change in rotational velocity of the secondary photosensitive drum in case that the gain is set to a relatively high value.
Figure 12B:
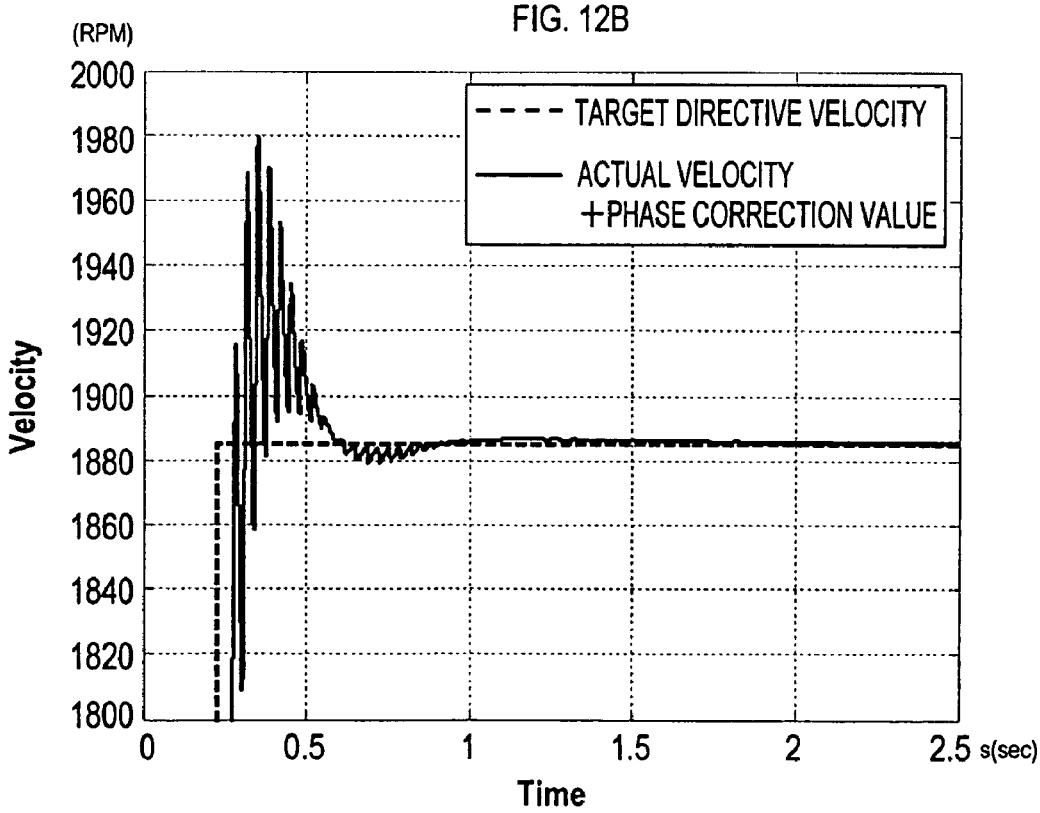

FIG. 12A is a graph showing the change in rotational velocity of the another photosensitive drum 3 (e.g., 3M) in case that the gain Gcomp is set to a relatively high value. FIG. 12B is a partially enlarged view of FIG. 12A. As seen from FIGS. 12A and 12B, when the gain Gcomp is set to be high, it was found that convergence of the phase difference is quick but the rotational phase (velocity) is easy to deviate even after the convergence of the phase difference.

Figure 13A:
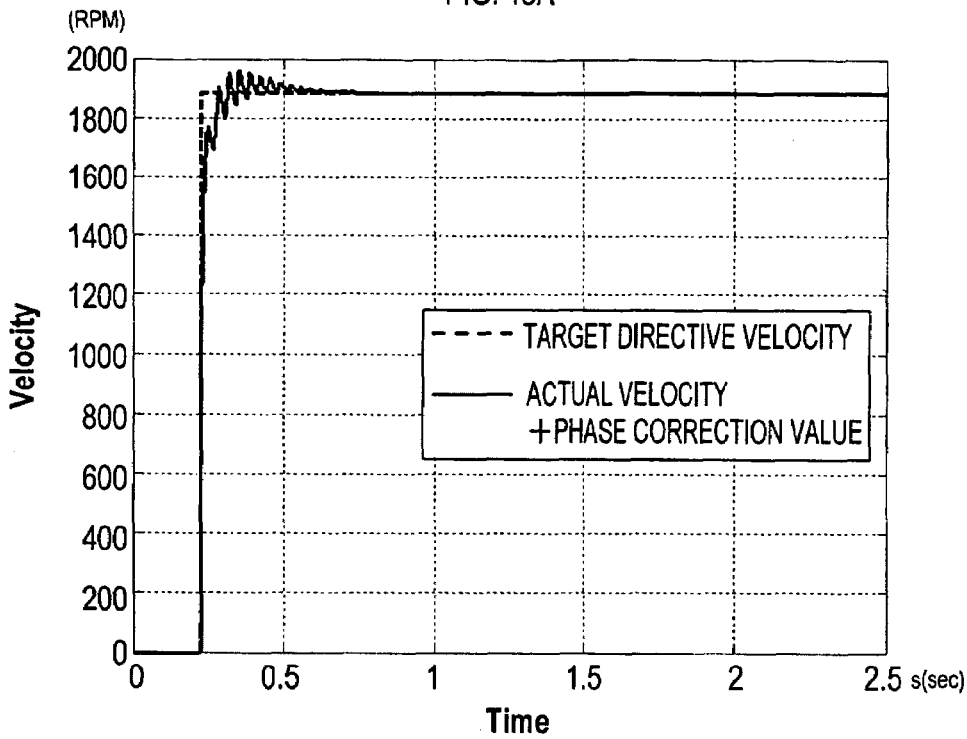
FIGS. 13A and 13B are graphs showing a change in rotational velocity of the secondary photosensitive drum in case that the gain is shifted from high to low.
Figure 13B:
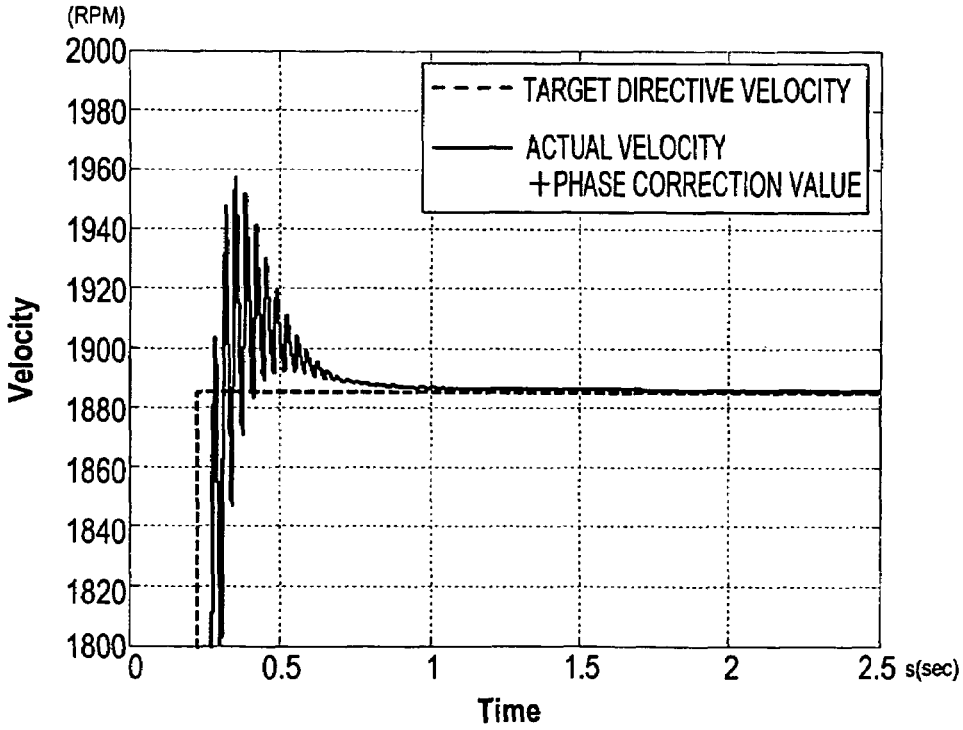

Accordingly in the present embodiment, the gain correction function unit 153 is designed to output the variable gain Gcomp which is large at the startup of the control and small at the convergence of the phase difference. FIGS. 13A and 13B show the change in rotational velocity of the another photosensitive drum 3 (e.g., 3M) when the gain Gcomp set high at the startup is linearly decreased after the startup, and maintained at a constant value by stopping the change of the gain Gcomp after 0.8 seconds. As can be seen by comparison between the case of FIGS. 13A and 13B, and the cases of FIGS. 11A, 11B, 12A and 12B, the time taken for the phase convergence is clearly shorter than the case at low gain. The velocity fluctuation at the phase convergence is smaller than the case at high gain on both oscillation amplitude and vestigial amplitude. As noted above, by setting the gain Gcomp to be high at the startup and low at the phase convergence, the phase difference is quickly converged and the rotational velocity and the phase difference can be reliably controlled to desired values.

Figure 14A:
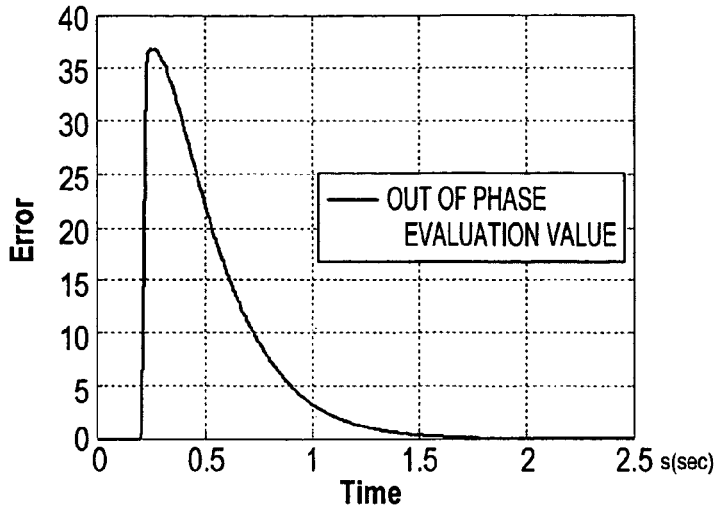
FIGS. 14A to 14C are graphs respectively showing a convergence state of a phase difference in the cases in FIGS. 11A and 11B, 12A and 12B, and 13A and 13B.
Figure 14B:
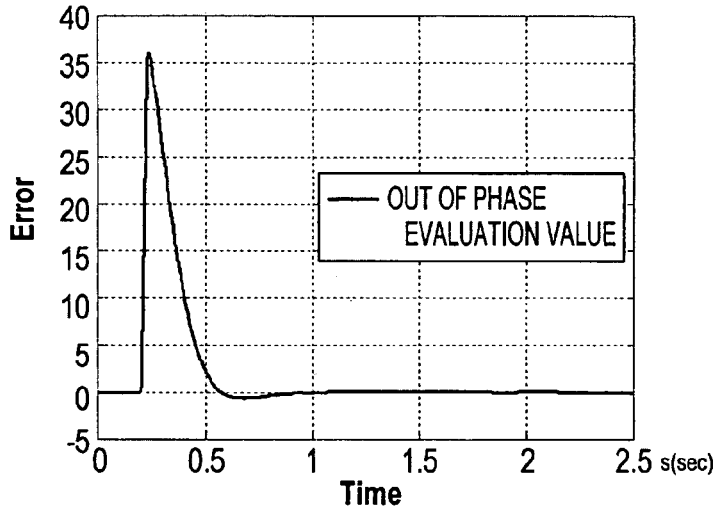
Figure 14C:
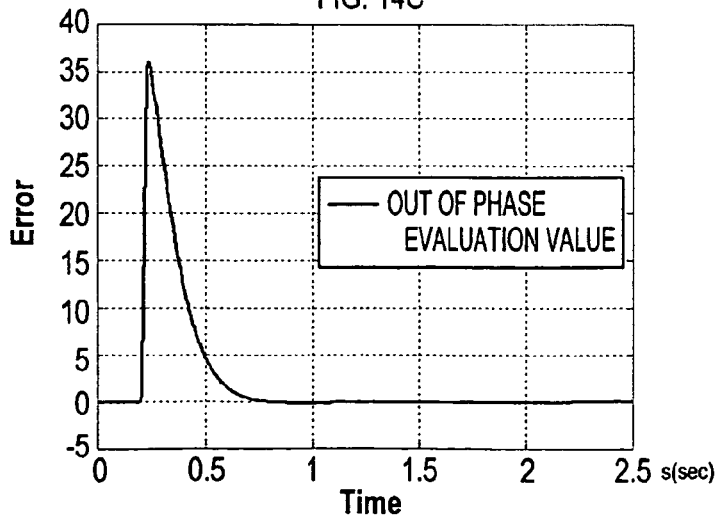

FIGS. 14A to 14C are graphs showing a converging state of the phase difference (error) in each of the above cases. FIG. 14A shows the case at low gain, FIG. 14B shows the case at high gain, and FIG. 14C is the case in which the gain Gcomp is changed from high to low as explained above. As shown in FIG. 14A, convergence of the phase difference is slow in the case at low gain. As seen from FIG. 14B, the phase difference is reliably maintained at zero even after the convergence. Also, vestigial wave occurs, and oscillation occurs due to slight disturbance. To the contrary, as shown in FIG. 14C, the time taken for convergence and the amount of oscillation are well balanced in case that the gain Gcomp is changed from high to low as explained above.

The gain Gcomp may be changed in various manners. As shown below, for example, the gain Gcomp may be switched by two steps, depending on whether the time T elapsed after the startup has exceeded a threshold δ.

$$G_{comp}=g_1 \text{ when } T<\delta$$

$$G_{comp}=g_2 \text{ when } T\geqq\delta \text{ where } g_1>g_2>0$$

In case that the gain correction function unit 153 is defined by the above equations, the gain Gcomp is set at a high gain $g_1$ so as to quickly converge the phase difference until time δ elapses after the startup. Then, after the time δ has elapsed, the gain Gcomp is set at a low gain $g_2$ to reliably converge the rotational velocity and the phase difference to desired values.

Also as shown below, the gain Gcomp may be set at the high gain $g_1$ until time $\delta_1$ elapses after the startup, and then may be linearly decreased until time $\delta_2$ to be maintained at the low gain $g_2$ after time $\delta_2$ has elapsed.

$$G_{comp} = g_1 \text{ when } T < \delta_1$$

$$G_{comp} = -\frac{g_1 - g_2}{\delta_2 - \delta_1}T + \frac{\delta_2 g_1 - \delta_1 g_2}{\delta_2 - \delta_1} \text{ when } \delta_1 \leq T < \delta_2$$

$$G_{comp} = g_2 \text{ when } T \geq \delta_2$$

Moreover, as shown below, the gain Gcomp may be decreased along an asymptote of an exponential function between $\delta_1$ and $\delta_2$.

$$G_{comp}=g_1 \text{ when } T<\delta_1$$

$$G_{comp}=Be^{-AT}+C \text{ when } \delta_1\leqq T<\delta_2$$

$$G_{comp}=g_2 \text{ when } T\geqq\delta_2$$

$$\text{where } g_1>g_2>0$$

Much smoother convergence of the phase difference is achieved in the latter two cases in which the Gcomp is consecutively decreased, as compared to the former case in which the gain Gcomp is decreased stepwisely.

[Variation of Driving Unit of Photosensitive Drum]

Figure 15:
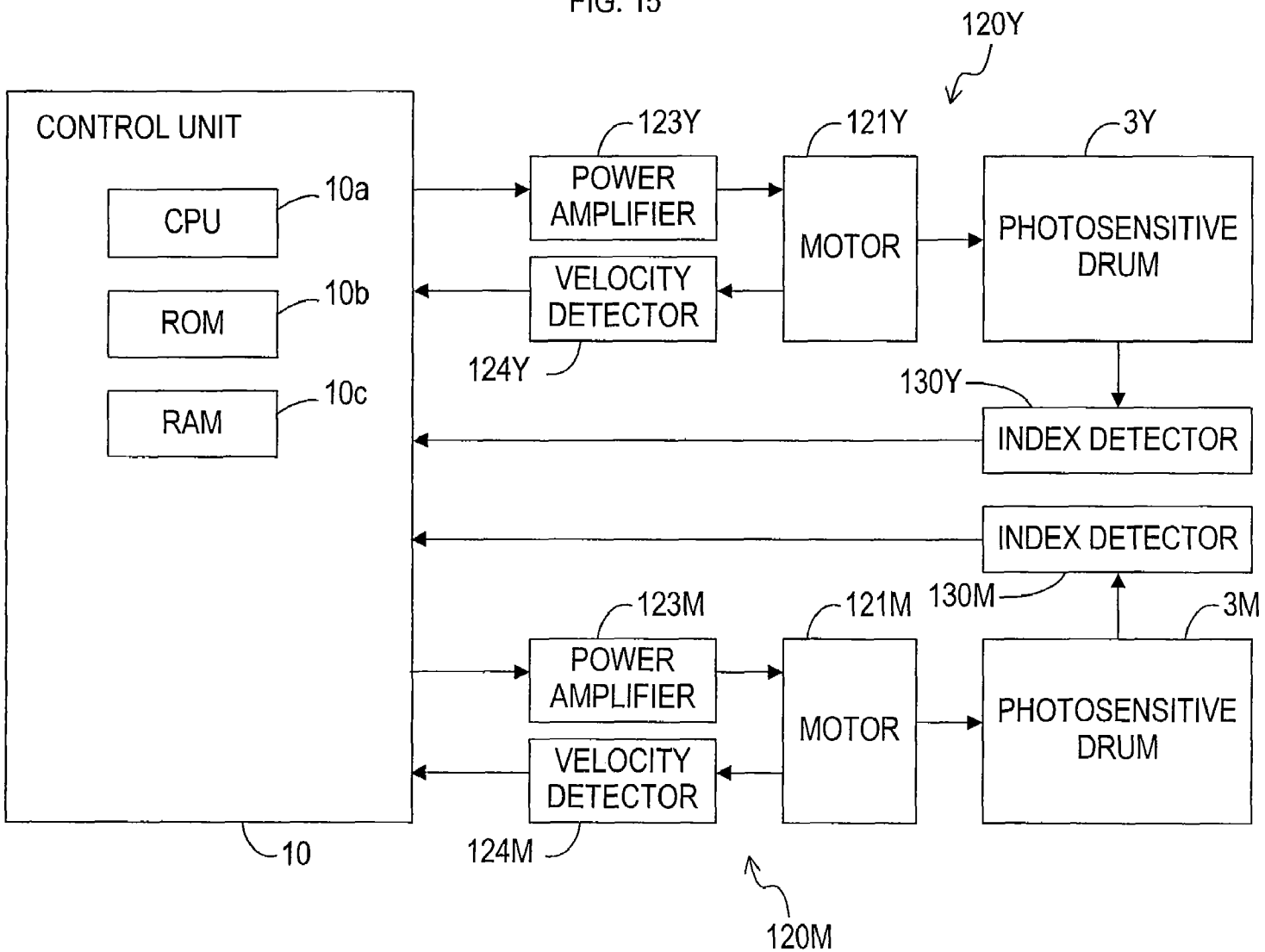
FIG. 15 is a block diagram showing a structure of a driving unit using software.

The above control can be also executed by a software process using a microcomputer. FIG. 15 is a block diagram showing a structure of a driving unit for use in executing the software process. FIG. 15 only shows the structure relevant to the photosensitive drums 3Y and 3M (driving units 120Y and 120M). However, the driving units 120C and 120B for the photosensitive drums 3C and 3B are designed in the same manner.

As shown in FIG. 15, in this control system, a signal from the control unit 10 (see FIG. 1) is inputted to the power amplifier 123, signals from the velocity detector 124 and the index detector 130 are inputted to the control unit 10. The control unit 10 is constituted of a known microcomputer including a CPU 10*a*, a ROM 10*b* and a RAM 10*c*. The control unit 10 executes the following process based on a program stored in the ROM 10*b*. Other than the components shown in FIG. 10, various components like an operation panel of the printer 1 are connected to the control unit 10. Illustrations of those components are omitted since there is not direct relationship with the process explained hereafter.

Figure 16:
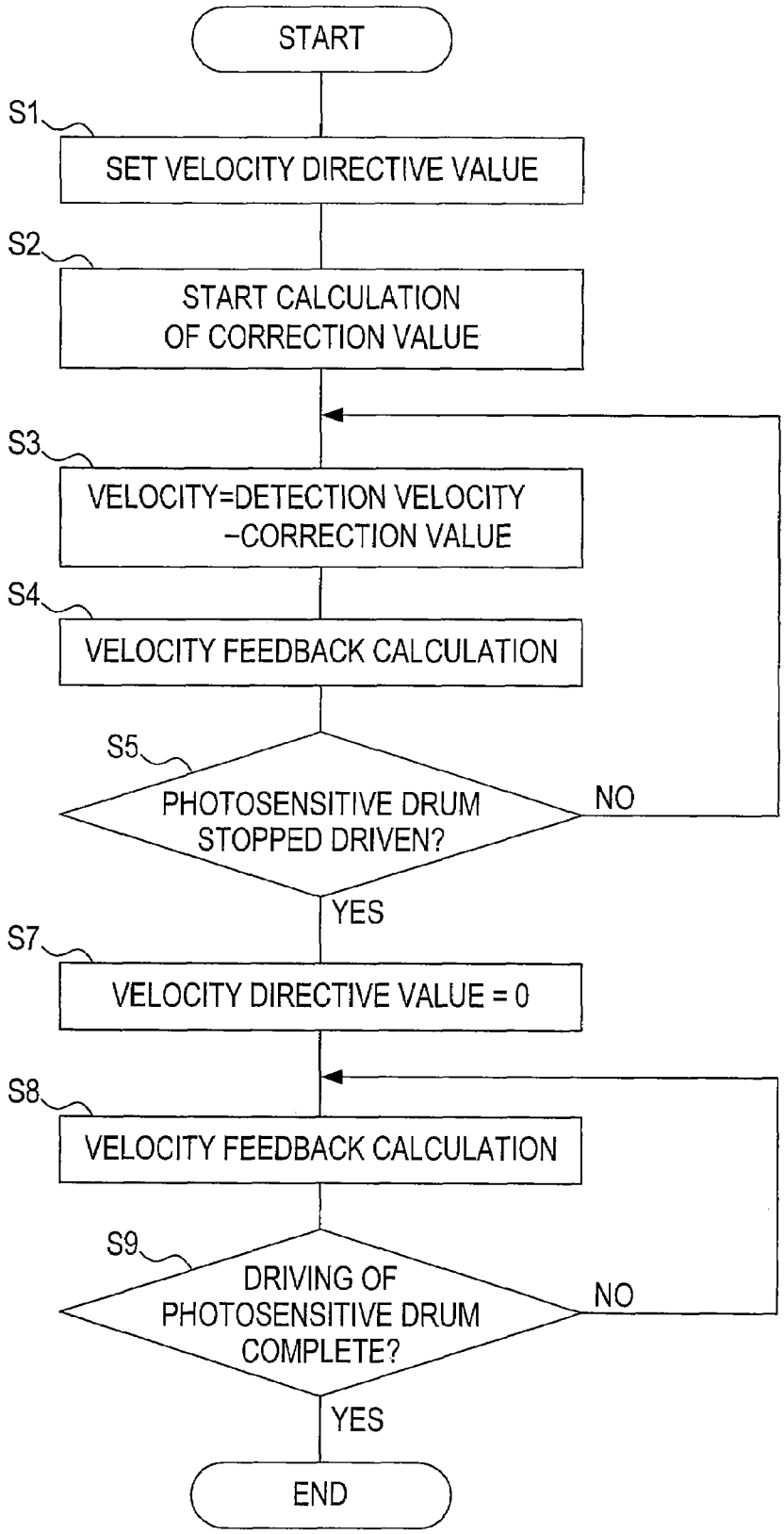
FIG. 16 is a flowchart illustrating a main routine executed by a control unit of the driving unit.

FIG. 16 is a flowchart illustrating a main routine of a velocity control process, executed by the control unit 10, to adjust the velocity of the photosensitive drum 3M. This process is started when a print directive is inputted from an external computer or the like to generate a driving directive for each of the photosensitive drums 3Y, 3M, 3C and 3B.

When the process is started, firstly in S1, a velocity directive value of the photosensitive drum 3M is set. In S2, calculation of a correction value is started by another routine. Detailed explanation will be later given on this another routine. Here, the correction value corresponds to the output of the transfer function calculator 143M.

Next in S3, the correction value at the time is subtracted from the detection velocity inputted from the velocity detector 124M. Based on the velocity after the subtraction, a known feedback calculation process is performed in S4. That is, in S4, a voltage inputted to the motor 121M is calculated so that the velocity calculated in S3 is consistent with the velocity corresponding to the above velocity directive value. When the input voltage is calculated in this manner, a signal corresponding to the input voltage is outputted to the power amplifier 123M by another routine.

In S5, it is determined whether the image data is processed and driving of the photosensitive drum 3M is complete. If not (S5: N), the process returns to S3 and the above steps are repeated. Otherwise (S5: Y), the process moves to S7 to set zero to the velocity directive value. In S8, a feedback calculation process in accordance with the velocity directive value is performed. In S9, it is determined whether the photosensitive drum 3M is stopped. If not (S9: N), the feedback calculation process in S8 is repeated. Otherwise (S9: Y), the process is ended.

Figure 17:
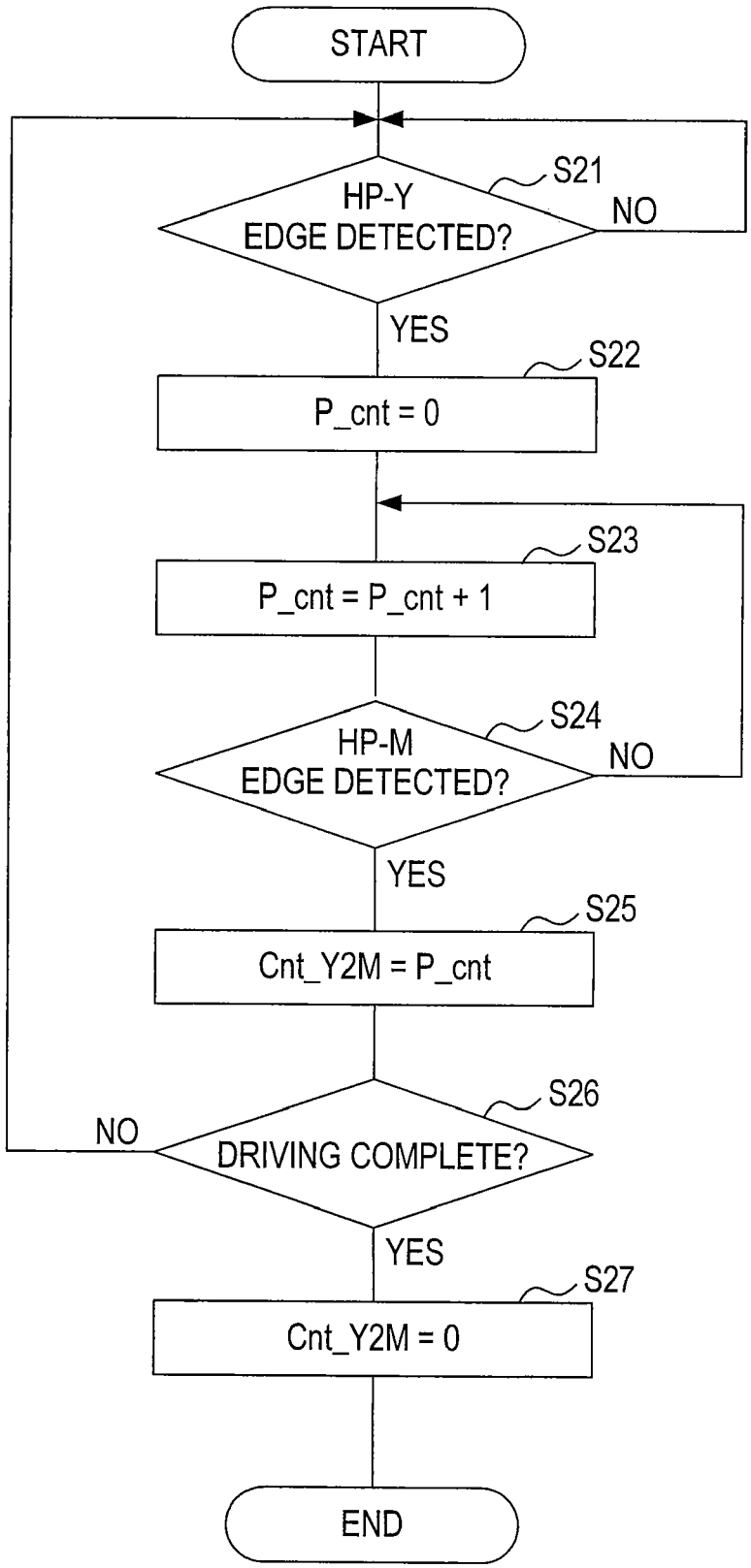
FIG. 17 is a flowchart illustrating a process of calculating a value Cnt_Y2M corresponding to an amount of phase delay in the main routine.
Figure 18:
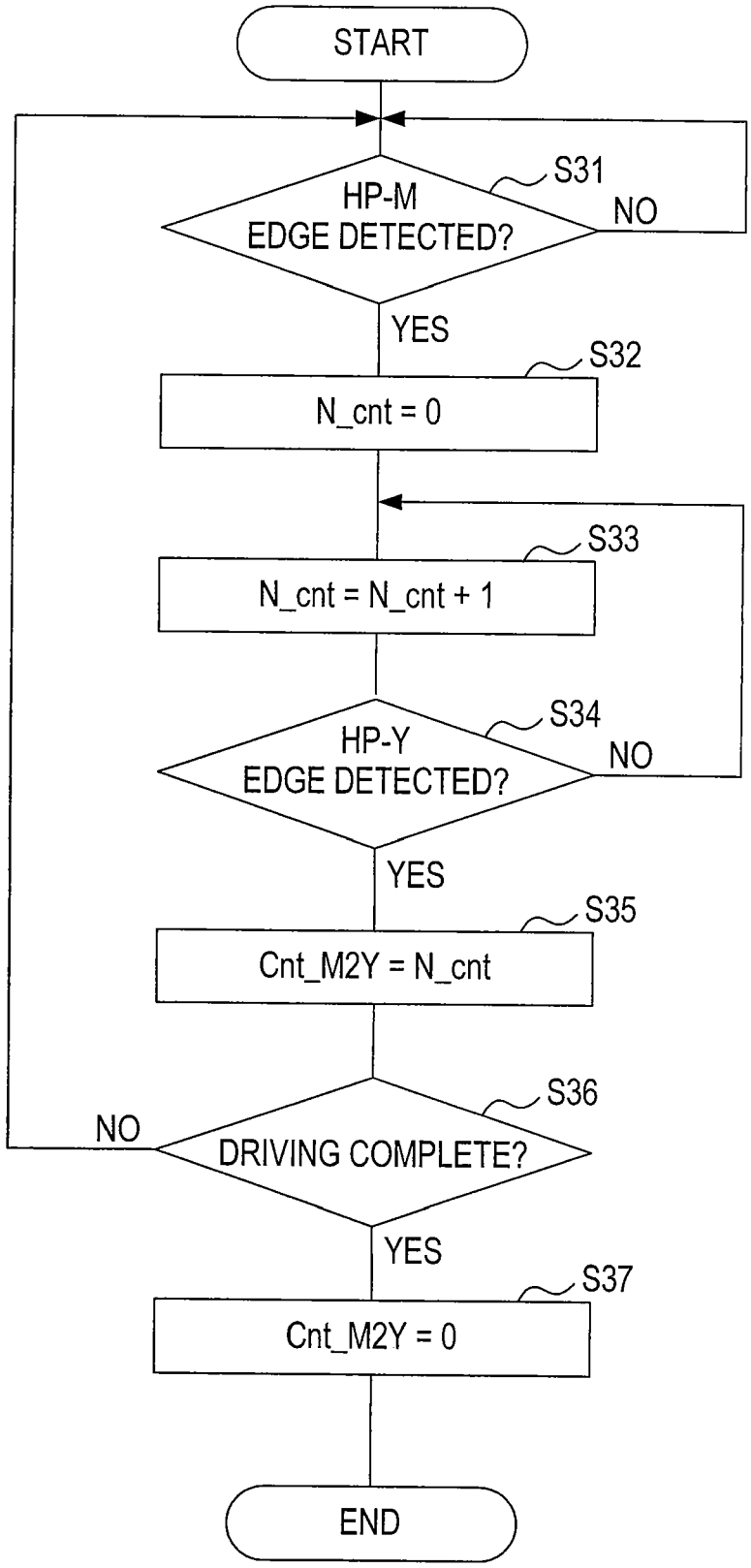
FIG. 18 is a flowchart illustrating a process of calculating a value Cnt_M2Y corresponding to an amount of phase advance in the main routine.
Figure 19:
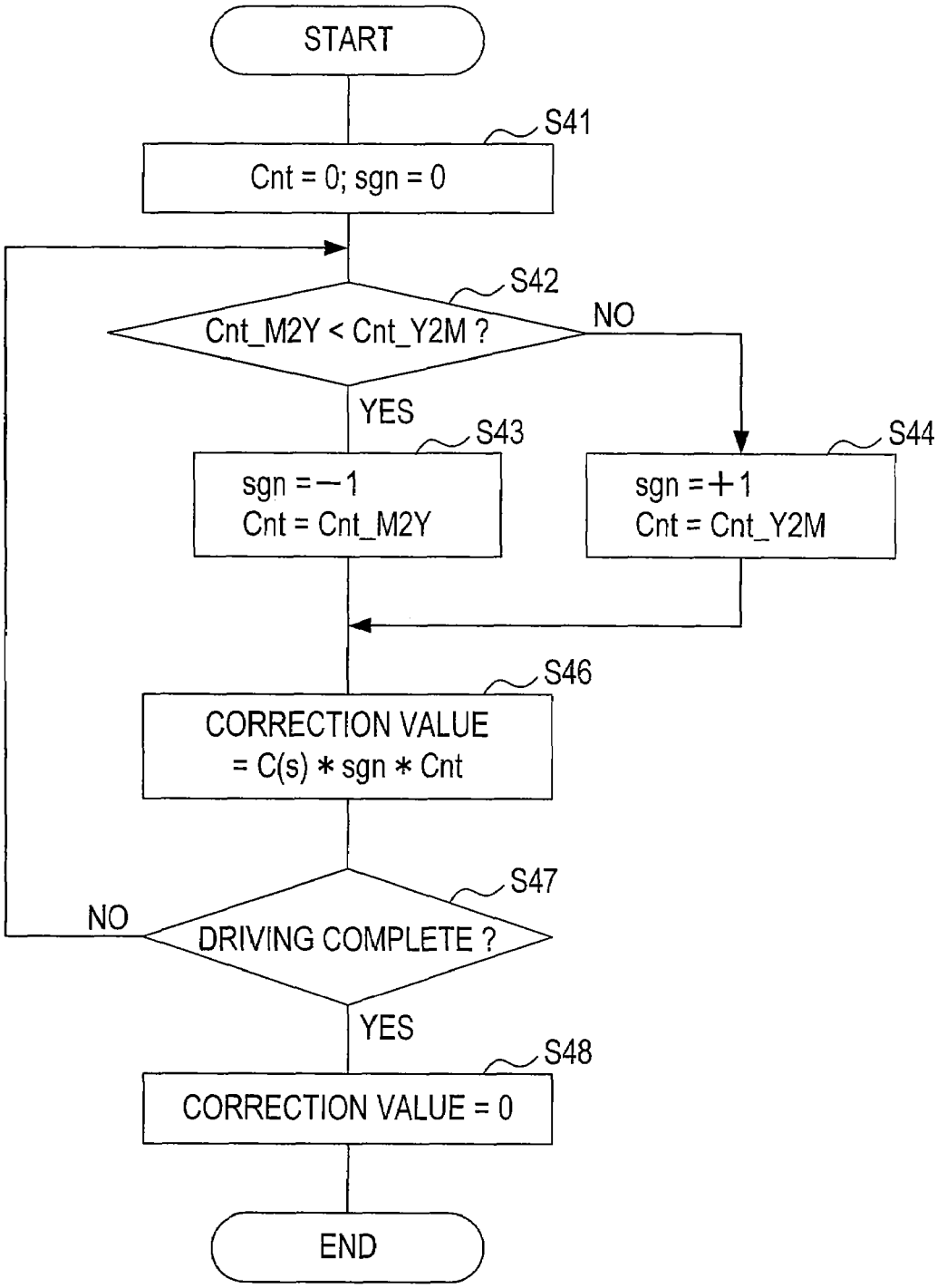
FIG. 19 is a flowchart illustrating a process of calculating a correction value in the main routine.

The calculation of the correction value which is started in S2 is made up of three processes performed in parallel as shown in FIGS. 17 to 19. Firstly, FIG. 17 is a flowchart illustrating a process of calculating a counter value Cnt_Y2M which corresponds to a phase delay amount of the photosensitive drum 3M to the photosensitive drum 3Y.

As shown in FIG. 17, when the process is started, firstly, it is determined in S21 whether an index signal is generated by the index detector 130Y (HP_Y edge detection). If not (S21: N), the process stands by at S21. Otherwise (S21: Y), a counter value P_cnt is cleared to zero in S22.

In S23, the counter value P_cnt is incremented by one. In S24, it is determined whether an index signal is generated by the index detector 130M (HP_M edge detection). If not (S24: N), the process returns to S23 to stand by while the counter P_cnt is incremented one by one. If an index signal is generated by the index detector 130M (S24: Y), the counter value P_cnt at the time is stored as the counter value Cnt_Y2M in S25.

Subsequently in S26, it is determined whether the driving of the photosensitive drums 3M and 3Y is completed. If not (S26: N), the process returns to S21 and the above steps are repeated. Otherwise (S26: Y), the counter value Cnt_Y2M is cleared to zero in S27. The process is ended.

FIG. 18 is a flowchart illustrating a process of calculating a counter value Cnt_M2M which corresponds to a phase advance amount of the photosensitive drum 3M to the photosensitive drum 3Y. As shown below, this process is designed substantially the same with the process in FIG. 17.

That is, when this process is started, firstly, it is determined in S31 whether an index signal is generated by the index detector 130M. If (S31: N), the process stands by in S31. If an index signal is generated by the index detector 130M (S31: Y), a counter value N_cnt is cleared to zero in S32.

Subsequently in S33, the counter value N_cnt is incremented by one. It is determined in S34 whether an index signal is generated by the index detector 130Y. If not (S34: N), the process returns to S38 to stand by while the counter value N_cnt is incremented one by one.

When an index signal is generated by the index detector 130Y (S34: Y), the counter value N_cnt at the time is stored as the counter value Cnt_M2Y in S35. Until the driving of the photosensitive drums 3M and 3Y is completed (S36: N), the above steps are repeated. When the driving is completed (S36: Y), the counter value Cnt_M2Y is cleared to zero in S37. The process is ended.

FIG. 19 is a flowchart illustrating a process of calculating the correction value from the counter values Cnt_Y2M and Cnt_M2Y stored at the time. As shown in FIG. 19, when the process is started, firstly in S41, variables Cnt and sgn are cleared to zero. Next in S42, it is determined which of the counter values Cnt_Y2M and Cnt_M2Y is larger. If Cnt_M2Y<Cnt_Y2M (S42: Y), −1 is set to sgn and Cnt_M2Y is set to Cnt in S43. If Cnt_M2Y≧Cnt_Y2M (S42: N), +1 is set to sgn and Cnt_Y2M is set to Cnt in S44.

In this manner, when the variables Cnt and sgn are set in S43 or S44, the process moves to S46 so that the correction value is calculated by C(s)*sgn*Cnt. Here, C(s) corresponds to a transfer function in the transfer function calculator 143M, which is the result of multiplication of the filter element (e.g., filter element for removing high frequency component) and the gain Gcomp. The correction value calculated in this manner is stored in a predetermined area in the RAM 10*c* to be used in the process in FIG. 16.

Subsequently in S47, it is determined whether the driving of the photosensitive drums 3M and 3Y is completed. If not (S47: N), the process returns to S42 to repeat the above steps. Otherwise (S47: Y), the correction value is cleared to zero in S48. The process is ended.

The aforementioned processes are also performed to each of the motors 121C and 121B. In this manner, the same control as in each of the driving units 120 shown in FIG. 2 can be performed. Also in the above process, the control is performed such that the smaller of the values Cnt_M2Y and Cnt_Y2M becomes zero. Accordingly, the phase difference can be quickly converged. In the process for the motor 121Y, the step S3 in FIG. 16 and the processes in FIGS. 17 to 19 may be omitted. The correction value is always equal to zero if the same program is applied. Accordingly, even if the step S3 in FIG. 16 and the processes in FIGS. 17 to 19 are performed to the motor 121Y, the same control can be performed as in the case in which there is such omission.

Also in the case of using a software program as above, the following control may be performed based on the temperature of the fixing unit 8 detected by the sensor 83. That is, while the temperature of the fixing unit 8 is low, it is necessary to converge the phase difference so quickly since image forming is unable to be performed. Also, when the temperature of the fixing unit 8 is low and the ambient temperature of the photosensitive drums 3 is low, it is preferable to cause oscillation in rotational velocity of the photosensitive drums 3 by setting a high gain, since toner remained on the surface of the photosensitive drums 3 is hard and a load applied when the photosensitive drums 3 are rotated is high due to friction with the paper conveying belt 6.

Figure 20:
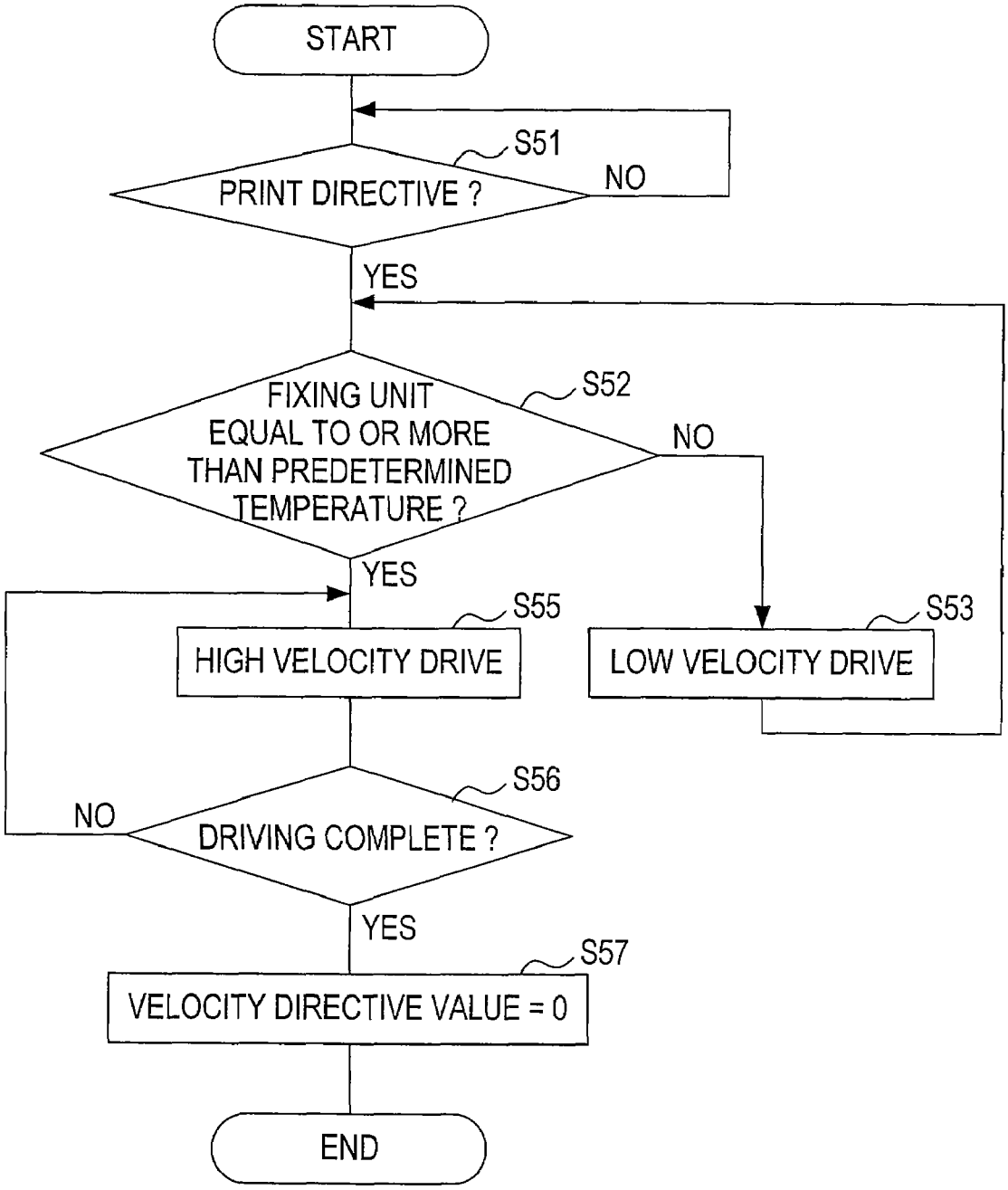
FIG. 20 is a flowchart illustrating control in consideration of a temperature of a fixing unit.

FIG. 20 is a flowchart illustrating the control in consideration of the temperature of the fixing unit 8. As shown in FIG. 20, when the process is started, firstly in S51, the process stands by until a print directive is received (S51: N). If a print directive is received (S51: Y), the process moves to S52. It is determined in S52 whether the temperature of the fixing unit 8 is equal to or more than a predetermined degree, particularly equal to or more than the softening temperature of toner, based on the signal from the sensor 83. If the temperature of the fixing unit 8 is less than the predetermined temperature (S52: N), low velocity drive is directed in S53. The process returns to S52. The predetermined temperature may be higher than the softening temperature of toner, e.g., equal to or more than the melting temperature of toner.

When low drive is directed in S53, the gain Gcomp is set to be relatively low. The velocity directive value is also set to be relatively low. Therefore, large stress is inhibited from being applied to the surface of the photosensitive drums 3. Life of the photosensitive drums 3 can be prolonged.

While the temperature of the fixing unit 8 is less than the predetermined temperature (S52: N), low velocity drive is continued. When the temperature of the fixing unit 8 is raised to the predetermined temperature (S52: Y), high velocity drive is directed. Then, the velocity directive value is set to the value at normal image forming. The gain Gcomp is set high at first, and low at the convergence of the phase difference as previously noted. The gain Gcomp may be changed in any of the previously described manners.

Subsequently, it is determined in S56 whether the driving of the photosensitive drums 3 is completed. If not (S56: N), the process moves to S55 to continue high velocity drive, Otherwise (S56: Y), the velocity directive value is set to zero in S57. The process is ended. That is, in the present process, after the temperature of the fixing unit 8 is raised to the predetermined temperature, that is, the temperature at which toner is softened and the load of the photosensitive drums 3 is small enough, a transition to high velocity drive (S55) takes place. Therefore, friction of the photosensitive drums 3 with the paper conveying belt 6 having stiff toner therebetween can be inhibited, and life of the photosensitive drums 3 can be prolonged. Particularly, at the startup of rotation of each of the photosensitive drums 3, the peripheral velocity of each of the photosensitive drums 3 (until reaching to a constant velocity rotation, there is variation in peripheral velocity among each of the photosensitive drums 3) and the moving velocity of the paper conveying belt 6 do not coincide with each other. However, the influence of the difference to the life of the photosensitive drums 3 can be limited to the minimum.

Figure 21:
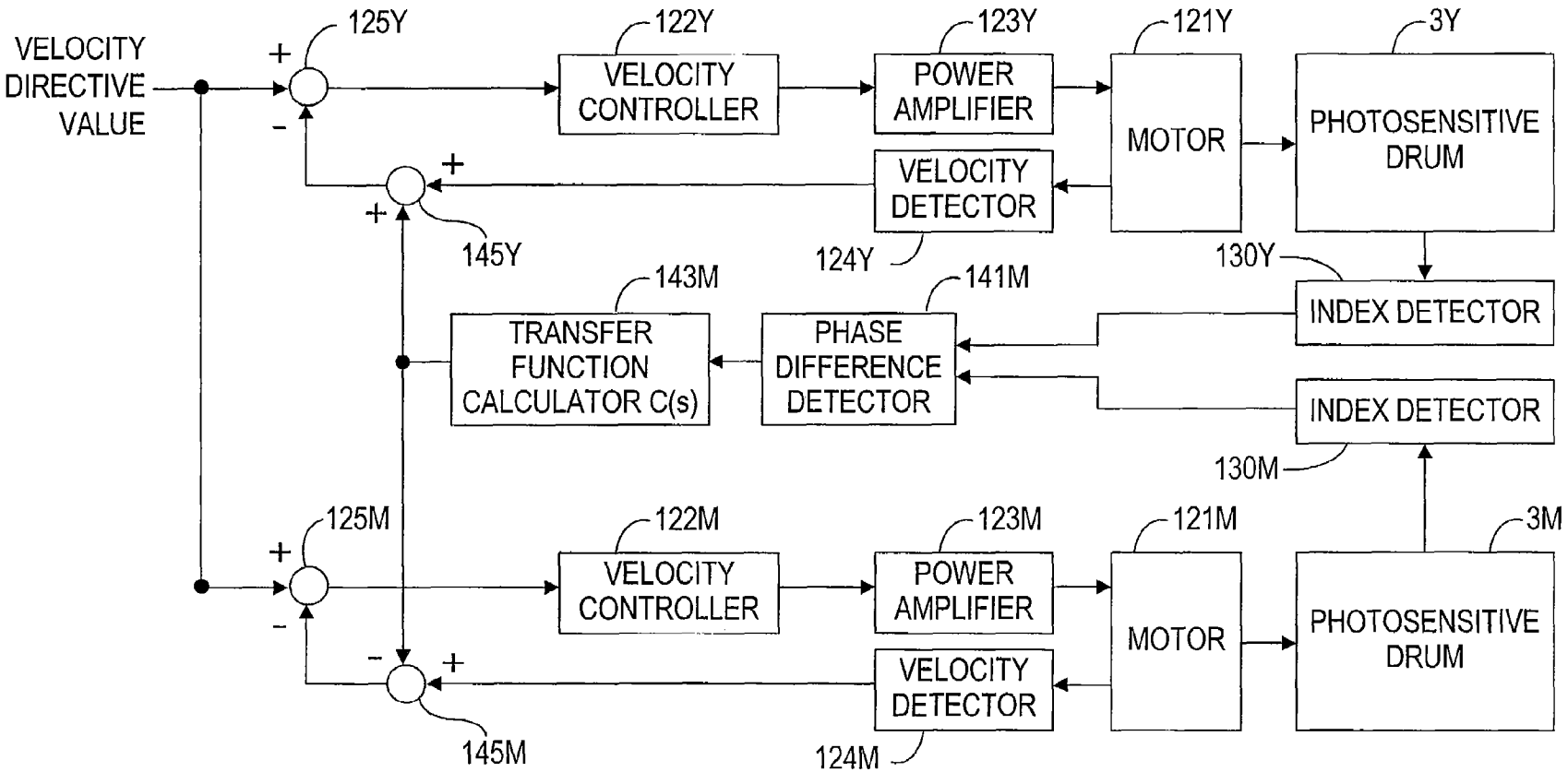
FIG. 21 is a block diagram showing structures of driving units for the photosensitive drums in a variation.

Also in the above embodiments, the normal feedback control is performed in the motor 121Y. However, the correction value in accordance with the phase difference may be reflected to the control of the motor 121Y. That is, as shown in FIG. 21, an adder 145Y is provided between the velocity detector 124Y and the subtracter 125Y, and the output of the transfer function calculator 143 (one of the transfer function calculators 143M, 143C and 143B; 143M in FIG. 21) is also inputted to the adder 145Y. In this manner, the correction value can be reflected to both of the controls of the motor 121Y and another motor 121 (one of the motors 121M, 121C and 121B; 121M in FIG. 21). Therefore, the phase difference can be converged all the more faster. In FIG. 21, the same reference number is given to the same components as in FIG. 2, and explanation thereof is repeated.

To realize such a control system, little ingenuity may be required for application in the case of three or more motors.

In the case of applying the control system to the printer 1 having four photosensitive drums 3, for example, two motors may be respectively connected to two photosensitive drums 3 via gears so that four photosensitive drums 3 are driven by the two motors.

In the case of applying the structures of the driving units 120 shown in FIG. 2 as well, two motors may be respectively connected to two photosensitive drums 3 via gears so that four photosensitive drums 3 are driven by the two motors.

In this case, these two motors may be controlled in the same manner as the two motors 121Y and 121M shown in FIG. 21.

Figure 22A:
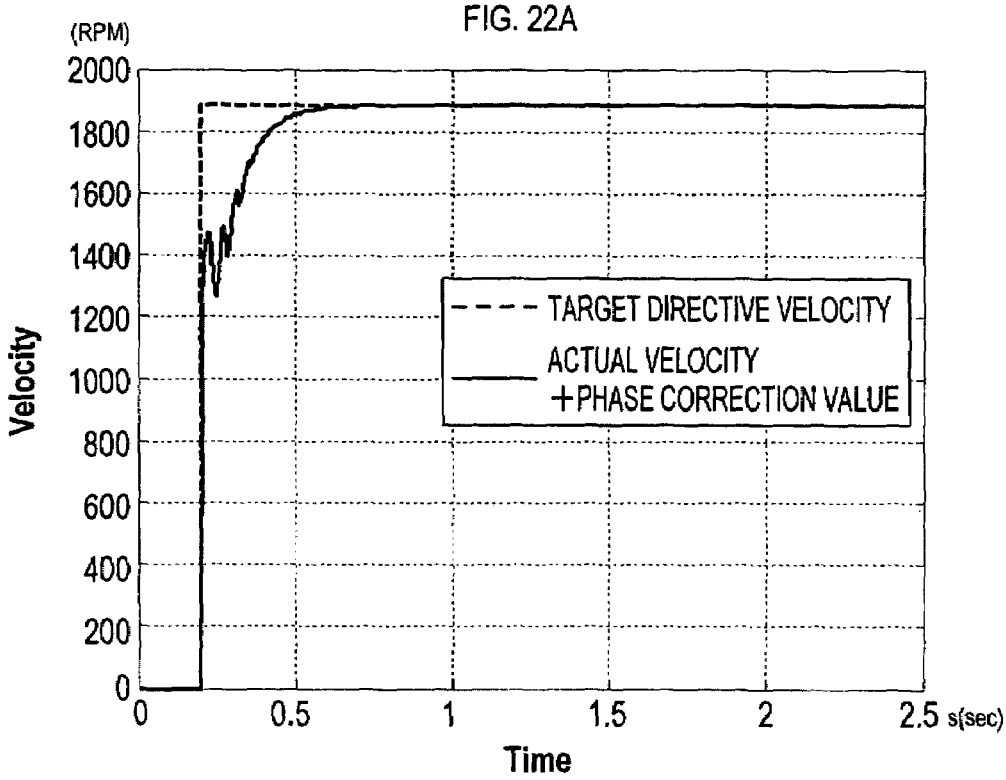
FIGS. 22A and 22B are graphs respectively showing a change in rotational velocity of the photosensitive drums in the variation.
Figure 22B:
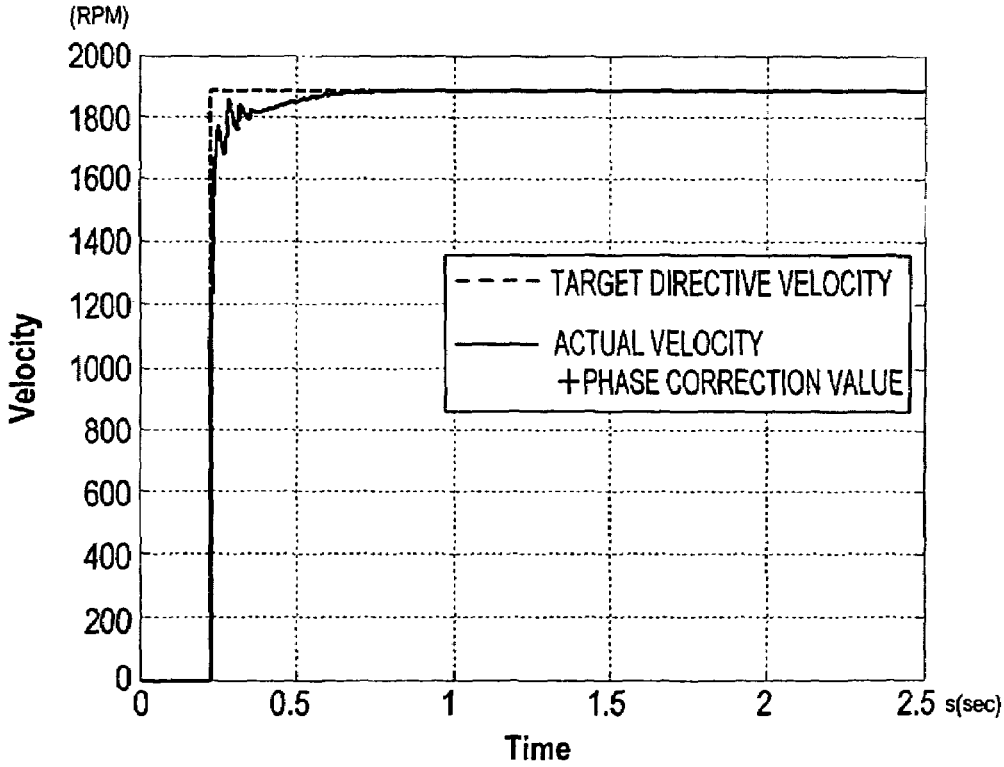
Figure 23A:
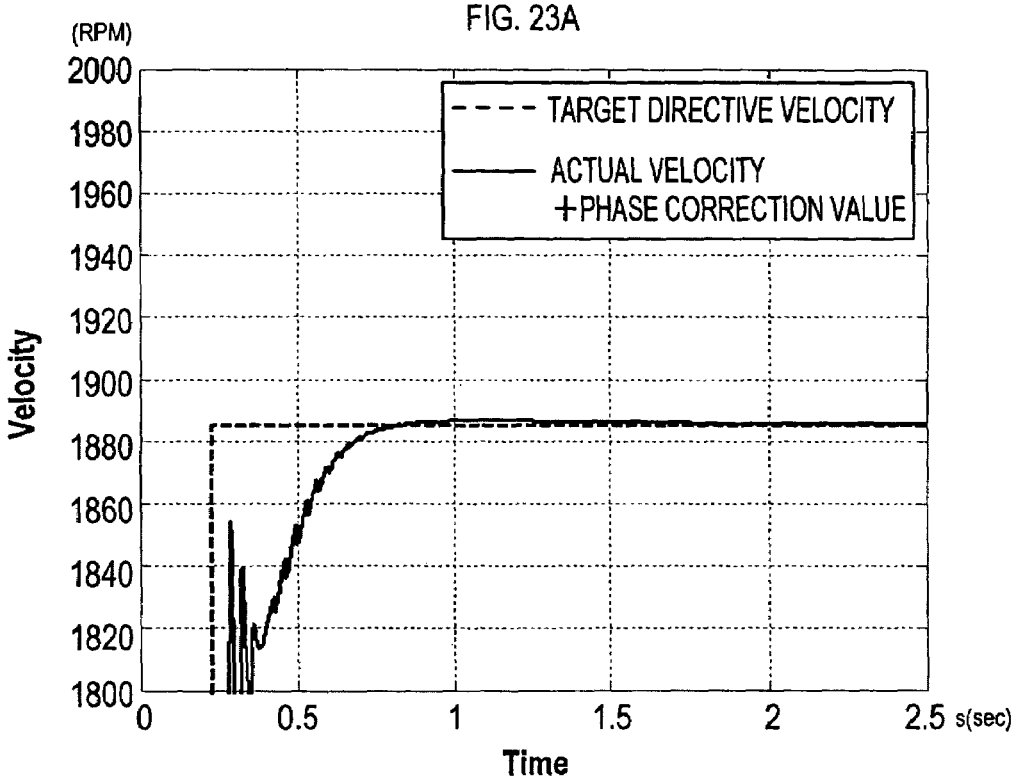
FIGS. 23A and 23B are graphs respectively showing a change in rotational velocity of a secondary photosensitive drum and a convergence state of a phase difference in the variation.
Figure 23B:
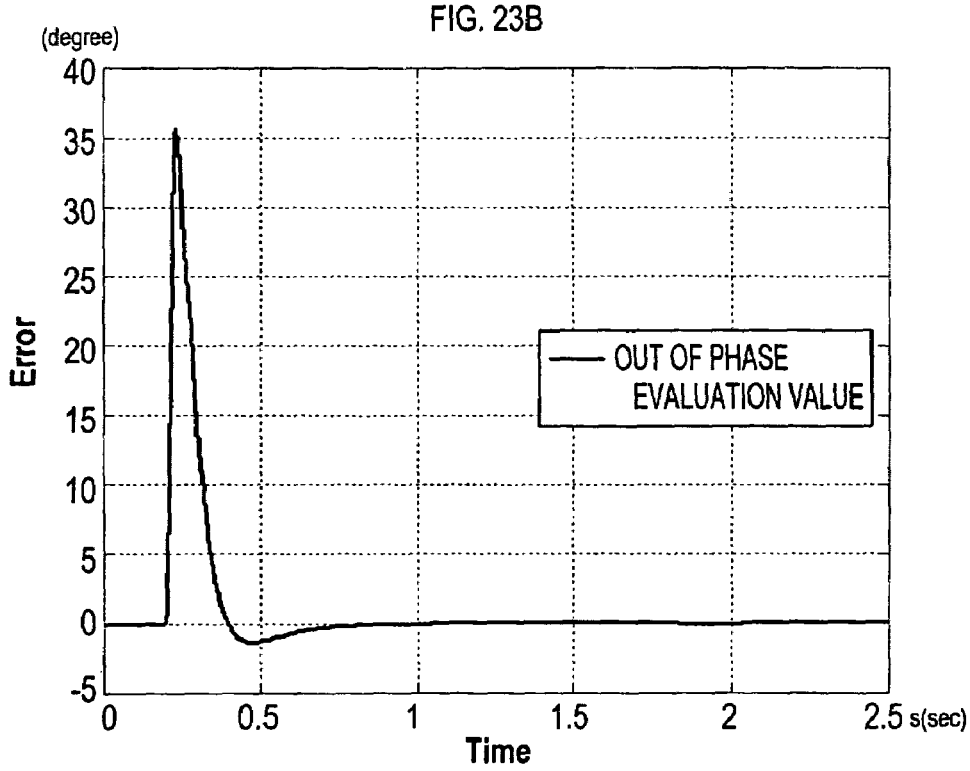

FIGS. 22A and 22B are graphs respectively showing the rotational velocity of each of the photosensitive drums 3Y and 3M in the control system of FIG. 21. FIG. 23A is a partially enlarged view of FIG. 22B. FIG. 23B is a graph showing convergence of the phase difference. As shown in FIGS. 22A, 22B, 23A and 23B, the phase difference can be reliably converged all the more faster by applying the correction value to both of the controls of the motors 121Y and 121M. Accordingly, in the control system in FIG. 21, the rotational velocity of each of the motors 121Y and 121M can be inhibited from exceeding the target rotational velocity. For this purpose, the output of the transfer function calculator 143M may be inputted to the subtracter 145M if the symbol of the output is positive, or to the adder 145Y if the symbol is negative.

The present invention is not limited to the above described embodiments. The present invention can be practiced in various manners without departing from the technical scope of the invention.

For instance, the present invention can be applied to various driving systems other than a driving system for an image forming apparatus, as well as a driving system including reciprocation movement of a piston other than a driving system including rotation movement.

Also in the above embodiments, the output of the velocity detector 124 is corrected in accordance with the output of the transfer function calculator 143. However, the velocity directive value may be corrected instead.

Moreover, the phase difference may not be necessarily controlled to be zero (timing at which each index signal is simultaneously generated). The phase difference may be controlled to be a specific value. For example, if a desired value which reflects eccentricity of each of the photosensitive drums 3 can be obtained by the aforementioned calibration, the phase difference may be controlled to the obtained value.

What is claimed is:

1. A motor control device comprising:

a velocity detection unit that detects each velocity of a plurality of driven bodies or of a plurality of motors which independently drives a corresponding one of the plurality of driven bodies, a motor control unit that independently controls each of the motors based on the velocity detected by the velocity detection unit and a predetermined velocity directive value;

a phase difference detection unit that detects a phase difference among each of the driven bodies;

a correction value calculation unit that calculates a correction value for the detected velocity or the velocity directive value based on the phase difference detected by the phase difference detection unit; and a feedback coefficient modification unit that increases a feedback coefficient for use in the calculation of the correction value by the correction value calculation unit at a startup of each of the motors so that the feedback coefficient at the startup is larger than the feedback coefficient at a constant velocity drive of each of the motors.

2. The motor control device according to claim 1, wherein the correction value calculation unit calculates the correction value by multiplying the phase difference detected by the phase difference detection unit, by the feedback coefficient.

3. The motor control device according to claim 1, wherein the feedback coefficient modification unit decreases the feedback coefficient after the startup of each of the motors.

4. The motor control device according to claim 1, wherein the feedback coefficient modification unit maintains the feedback coefficient at a predetermined value for a predetermined time after the startup of each of the motors, and then decreases the feedback coefficient.

5. The motor control device according to claim 1, wherein the correction value is one of a correction value for correcting the velocity of each of the driven bodies or motors detected by the velocity detection unit, and a correction value for correcting the velocity directive value for use in independent control of each of the motors by the motor control unit.

6. The motor control device according to claim 1, wherein the feedback coefficient modification unit modifies the feedback coefficient in accordance with a driving load of each of the driven bodies.

7. The motor control device according to claim 1, wherein the phase difference detection unit detects a difference between a reference phase which is a phase of one of the plurality of driven bodies and a phase of at least another one of the driven bodies.

8. The motor control device according to claim 7, wherein the correction value calculation unit calculates the correction value for the detected velocity or the velocity directive value of at least one of the driven bodies except for the one having the reference phase, based on the phase difference detected by the phase difference detection unit.

9. The motor control device according to claim 7, wherein the correction value calculation unit calculates the correction value for the detected velocity or the velocity directive value of at least one of the motors driving at least one of the driven bodies except for the one having the reference phase, based on the phase difference detected by the phase difference detection unit.

10. The motor control device according to claim 7, wherein the correction value calculation unit calculates the correction value for the detected velocity or the velocity directive value of each of the driven body having the reference phase and at least one of the driven bodies except for the one having the reference phase, based on the phase difference detected by the phase difference detection unit.

11. The motor control device according to claim 7, wherein the correction value calculation unit calculates the correction value for the detected velocity or the velocity directive value of each of the motor driving the driven body having the reference phase and at lease one of the motors driving at least one of the driven bodies except for the one having the reference phase, based on the phase difference detected by the phase difference detection unit.

12. The motor control device according to claim 1, wherein the correction value calculation unit includes a filter member that removes a predetermined frequency component from the phase difference detected by the phase difference detection unit, wherein the correction value calculation unit calculates the correction value for the detected velocity or the velocity directive value based on the phase difference from which the predetermined frequency component is removed by the filter member.

13. An image forming apparatus comprising:

a motor control device including a velocity detection unit that detects each velocity of a plurality of driven bodies or of a plurality of motors which independently drives a corresponding one of the plurality of driven bodies, a motor control unit that independently controls each of the motors based on the velocity detected by the velocity detection unit and a predetermined velocity directive value, a phase difference detection unit that detects a phase difference among each of the driven bodies, a correction value calculation unit that calculates a correction value for the detected velocity or the velocity directive value based on the phase difference detected by the phase difference detection unit, and a feedback coefficient modification unit that increases a feedback coefficient for use in the calculation of the correction value by the correction value calculation unit at a startup of each of the motors so that the feedback coefficient at the startup is larger than the feedback coefficient at a constant velocity drive of each of the motors;

a plurality of motors controlled by the motor control device; and a plurality of photoreceptors, each of which is independently driven by a corresponding one of the plurality of motors.

14. The image forming apparatus according to claim 13 further comprising:

an exposing unit that exposes each of the plurality of photoreceptors to form an electrostatic latent image on a surface thereof;

a developing unit that performs development by applying a developer to the electrostatic latent image; and a transfer unit that transfers the developer applied to the electrostatic latent image to a recording medium.

15. The image forming apparatus according to claim 14 further comprising:

a fixing unit that heats and fixes the developer transferred to the recording medium, wherein the feedback coefficient modification unit modifies the feedback coefficient in accordance with a driving load of each of the plurality of photosensitive drums which changes depending on a heating state of the fixing unit; and wherein the feedback coefficient modification unit modifies the feedback coefficient in accordance with a driving load of each of the driven bodies.

16. The image forming apparatus according to claim 15 further comprising a detection unit that detects a temperature in the vicinity of the fixing unit, wherein the feedback coefficient modification unit modifies the feedback coefficient based on the temperature detected by the detection unit.

17. A motor control method comprising the steps of:

detecting each velocity of a plurality of driven bodies or of a plurality of motors which independently drives a corresponding one of the plurality of driven bodies;

independently controlling each of the motors based on the detected velocity and a predetermined velocity directive value;

detecting a phase difference among each of the driven bodies;

calculating a correction value for the detected velocity or the velocity directive value based on the detected phase difference; and increasing a feedback coefficient for use in the calculation of the correction value at a startup of each of the motors so that the feedback coefficient at the startup is larger than the feedback coefficient at a constant velocity drive of each of the motors.

* * * * *

UNITED STATES PATENT AND TRADEMARK OFFICE

CERTIFICATE OF CORRECTION

PATENT NO. : 7,561,829 B2
APPLICATION NO. : 11/567273
DATED : July 14, 2009
INVENTOR(S) : Shigeki Akiyama It is certified that error appears in the above-identified patent and that said Letters Patent is hereby corrected as shown below:

In Column 16, Claim 11, Line 5:
Please delete "at lease" and insert --at least--

Signed and Sealed this

Twenty-fourth Day of November, 2009

David J. Kappos

David J. Kappos
*Director of the United States Patent and Trademark Office*